US008317549B2

(12) United States Patent
Falchetti

(10) Patent No.: US 8,317,549 B2
(45) Date of Patent: Nov. 27, 2012

(54) CLAMP FOR A MALE TERMINAL

(75) Inventor: Antonio Falchetti, Codogno (IT)

(73) Assignee: MTA S.p.A., Codogno (IT)

( * ) Notice: Subject to any disclaimer, the term of this patent is extended or adjusted under 35 U.S.C. 154(b) by 65 days.

(21) Appl. No.: 13/123,543

(22) PCT Filed: Oct. 14, 2008

(86) PCT No.: PCT/IT2008/000645

§ 371 (c)(1),
(2), (4) Date: Apr. 11, 2011

(87) PCT Pub. No.: WO2010/044111

PCT Pub. Date: Apr. 22, 2010

(65) Prior Publication Data

US 2011/0195615 A1 Aug. 11, 2011

(51) Int. Cl.
*H01R 4/28* (2006.01)

(52) U.S. Cl. ..... 439/762

(58) Field of Classification Search ..... 439/402, 439/411, 781, 271, 413, 521, 811, 762
See application file for complete search history.

(56) References Cited

U.S. PATENT DOCUMENTS

| | | | | |
|---|---|---|---|---|
| 5,041,012 | A * | 8/1991 | Caprio | 439/413 |
| 5,302,143 | A | 4/1994 | Inoue et al. | |
| 5,302,144 | A * | 4/1994 | Francois et al. | 439/781 |
| 6,086,406 | A * | 7/2000 | Francois et al. | 439/402 |
| 2005/0176282 | A1 | 8/2005 | Hirthammer | |
| 2008/0020612 | A1 * | 1/2008 | Clark et al. | 439/100 |
| 2011/0039430 | A1 * | 2/2011 | Aftanas | 439/92 |

FOREIGN PATENT DOCUMENTS

| | | | |
|---|---|---|---|
| DE | 197 34 809 | A1 | 3/1999 |
| DE | 20 2005 006 400 | U1 | 8/2006 |
| EP | 1 826 844 | A2 | 8/2007 |
| GB | 818 030 | A | 8/1959 |
| JP | 4007567 | Y2 | 2/1992 |

* cited by examiner

*Primary Examiner* — Neil Abrams
*Assistant Examiner* — Phuongchi Nguyen
(74) *Attorney, Agent, or Firm* — Tarolli, Sundheim, Covell & Tummino LLP

(57) ABSTRACT

A clamp for male terminal comprising a clamping ring capable of inserting on a male terminal, two jaws connected to the clamping ring and mutually approachable to tighten the clamping ring on the male terminal, clamping means acting on the jaws to move them between a distant position and a close position along a clamping direction. The clamping means comprise a clamping member rotating around a clamping axis inclined with respect to a plane perpendicular to the axis of the clamping ring. The clamp further comprises guiding means cooperating with a movable jaw to guide the movement of such movable jaw along the clamping direction on said plane, between the distant position and the close position.

13 Claims, 25 Drawing Sheets

CLAMP FOR A MALE TERMINAL

TECHNICAL FIELD

The present invention relates to a clamp for a male terminal.

In particular, the present invention relates to a clamp with inclined clamping screw.

The clamp of the present invention can find application for the connection to a battery post. In this case, the male terminal is a battery post while the clamp is connected to one or more utilities of a motor vehicle.

According to a different application, the clamp of the present invention can find application for the grounding of electric and/or electronic devices. In this case, the male terminal is a ground terminal secured to a structure serving as earth ground, while the ground connection of the devices to be grounded is connected to the clamp by electric cable. The structure serving as earth ground can be, for example, the body of a motor vehicle, in particular of a car.

BACKGROUND OF THE INVENTION

An inclined-clamping battery terminal clamp is disclosed for example in the Japanese publication 4-7567. This document describes a clamp having a tubular element capable of engaging a battery post projecting out of a battery, a couple of arms to close the tubular element and clamping means of the screw-nut type placed between the couple of arms. In such clamp, the screw is placed as inclined with respect to the plane perpendicular to the tubular element axis.

A different inclined-clamping battery terminal clamp is disclosed for example in the application for the German utility model DE 20 2005 006 400. This document describes a clamp comprising a clamping ring having a cylindrical opening for coupling to a battery post, two opposed flanges divided from each other by a groove and a clamping system to move close/away the two flanges so as to tighten/unloose the cylindrical opening on the battery post. The clamping ring and the flanges lie on a common plane perpendicular to the cylindrical opening axis. The clamping system comprises a screw extended along an axis oriented between 5° and 45° with respect to the common plane of the clamping ring and of the flanges and a clamping nut mounted on the screw. One end of the screw engages one of the two flanges while the nut, mounted at the opposite end, engages the other flange.

In both the above-mentioned clamps, the tightening of the clamp on a battery post occurs by rotating the clamping nut with respect to the screw. In particular, referring to the DE 20 2005 006 400 model, since one end of the screw engages one of the two flanges, the rotation of the nut around the screw and its engagement with the other flange cause the two flanges to move closer to each other along a direction coinciding with the axis of the screw itself. However, this clamping system causes the flanges to twist resulting in a corresponding torsion of the clamping ring. In fact, it is necessary to note that the two flanges are forced to move one toward the other along the screw axis during the tightening. This mutual approach along the screw axis causes at least one of the two flanges or both of them, according to the structure rigidity of the two branches of the clamping ring, to move away from the plane where it lies in the open position moving on a parallel plane to the close position.

In the light of what evidenced above it rises the need to provide a clamp for male terminal with a clamping system preventing the rotation of the two clamping flanges during the tightening operations of the clamp on the male terminal.

SUMMARY OF THE INVENTION

The object of the present invention is therefore to propose a clamp for male terminal having such features as to meet said need, while overcoming the drawbacks of the known art.

This object is reached by a clamp for male terminal comprising a clamping ring having an axis, said clamping ring being able to insert on a male terminal according to an insertion direction extended along said axis, two jaws connected to said clamping ring and mutually approaching to tighten the clamping ring on the male terminal, at least one of said jaws being movable, clamping means acting on said jaws to move said jaws between a distant position and a close position along a clamping direction, wherein said clamping means comprise a clamping member rotatable around a clamping axis to move the jaws between said distant position and said close position, said clamping axis being inclined with respect to a plane perpendicular to the axis of the clamping ring so as to form with said plane an angle different from the right angle, wherein said clamp comprises guiding means cooperating with said at least one movable jaw to guide the movement of said at least one movable jaw along said clamping direction on said plane, between said distant position and said close position.

Thanks to the fact that the clamp is equipped with guiding means cooperating with at least one movable jaw to guide the movement of said movable jaw on the plane perpendicular to the clamping ring axis, the tightening of the two jaws occurs without producing any torsions on the jaws and on the clamping ring.

BRIEF DESCRIPTION OF THE DRAWINGS

Further features and advantages of the clamp according to the present invention will become apparent from the following description of one preferred exemplary embodiment thereof, which is given by way of illustration and without limitation, with reference to the accompanying drawings, in which.

DETAILED DESCRIPTION OF EMBODIMENTS OF THE INVENTION

Figure 1:
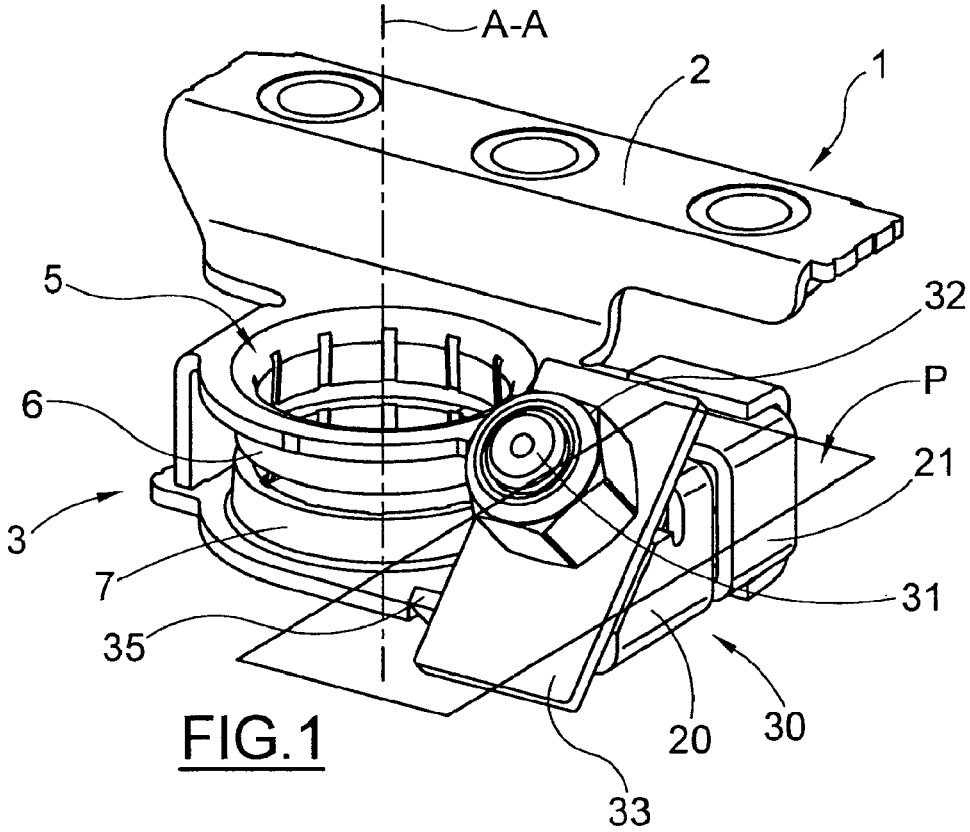
FIG. 1 shows a perspective view of a first embodiment of a clamp according to the present invention, with the jaws in distant position.
Figure 2:
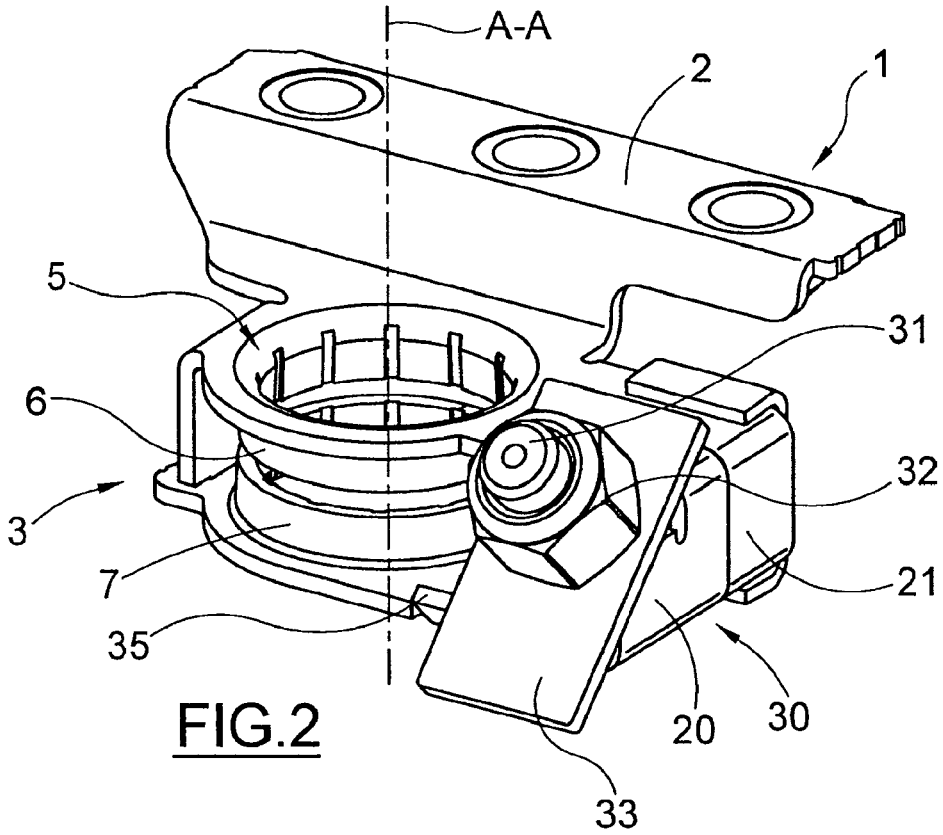
FIG. 2 shows a perspective view of the clamp of FIG. 1, with the jaws in close position.
Figure 3:
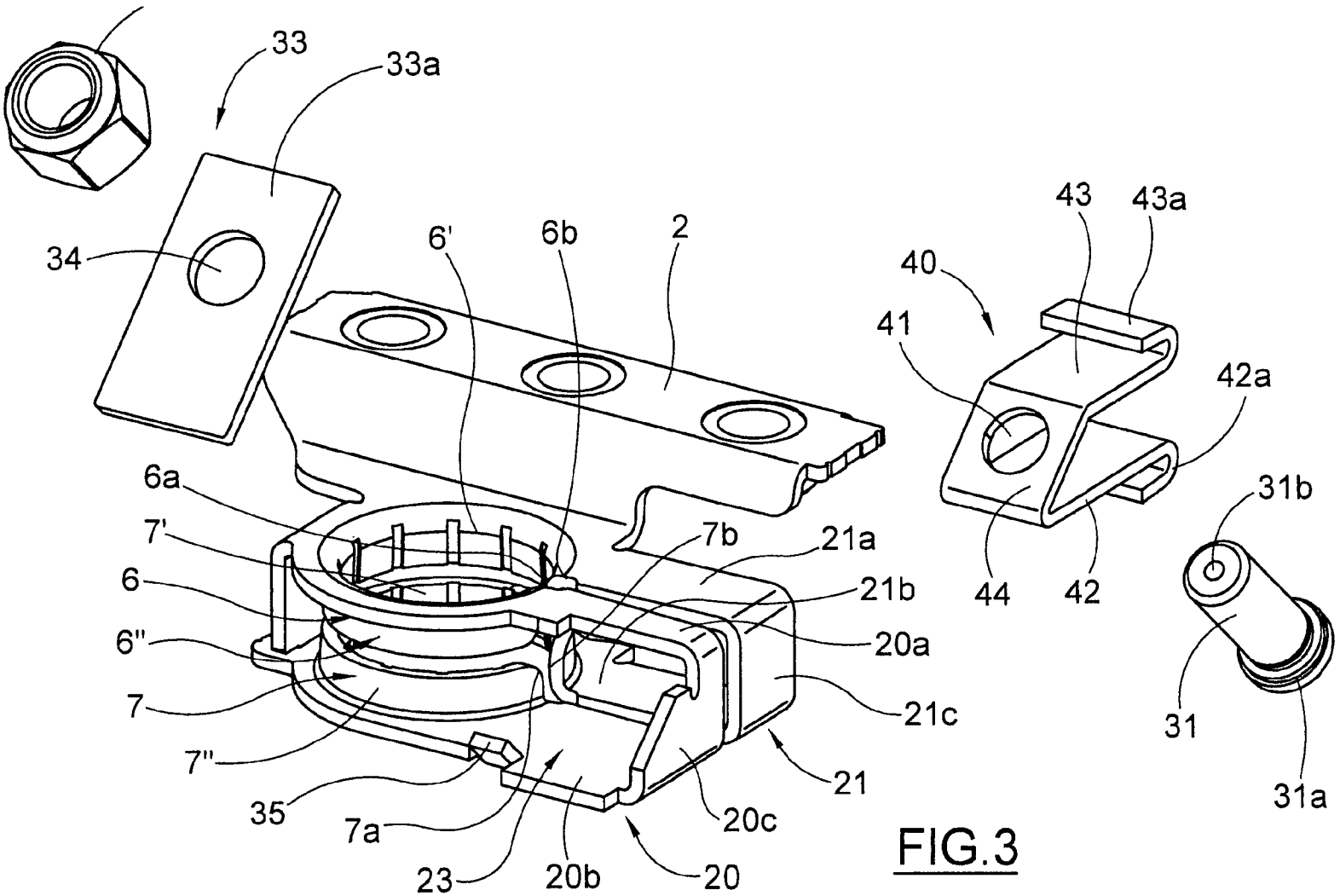
FIG. 3 shows an exploded perspective view of the clamp of FIG. 1.
Figure 4:
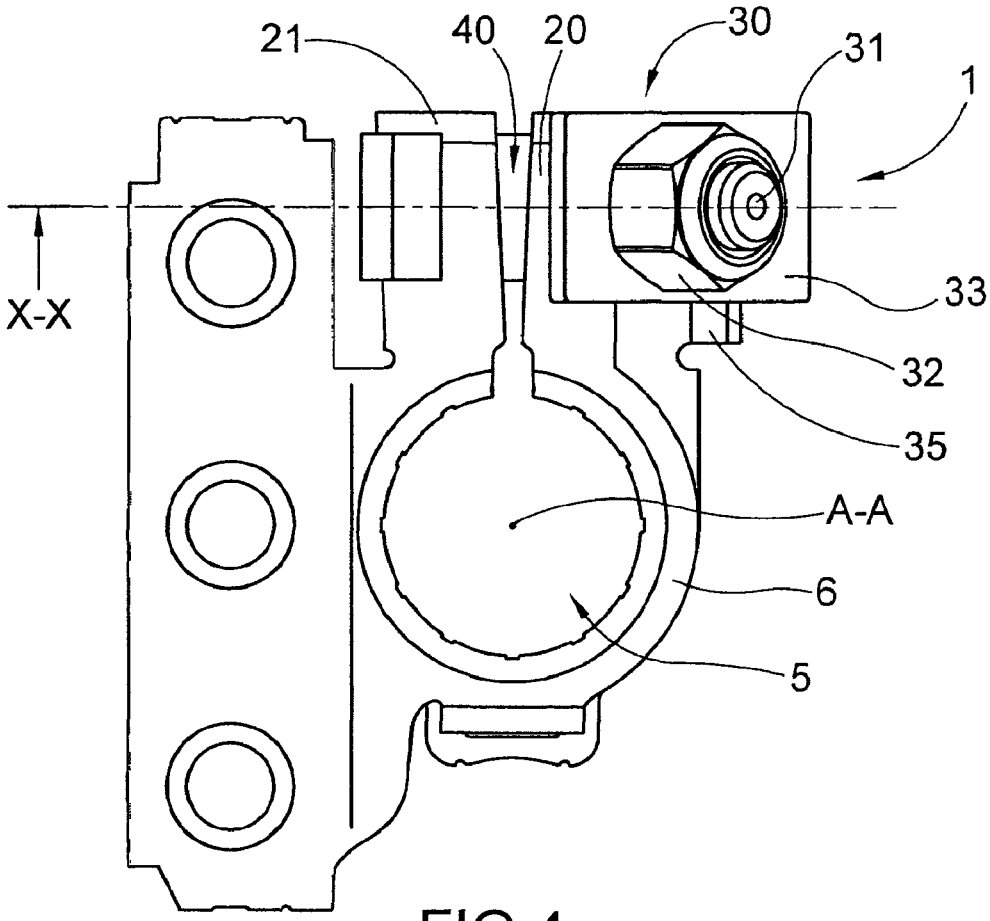
FIGS. 4 to 6 show different flat views of the clamp of FIG. 1.
Figure 5:
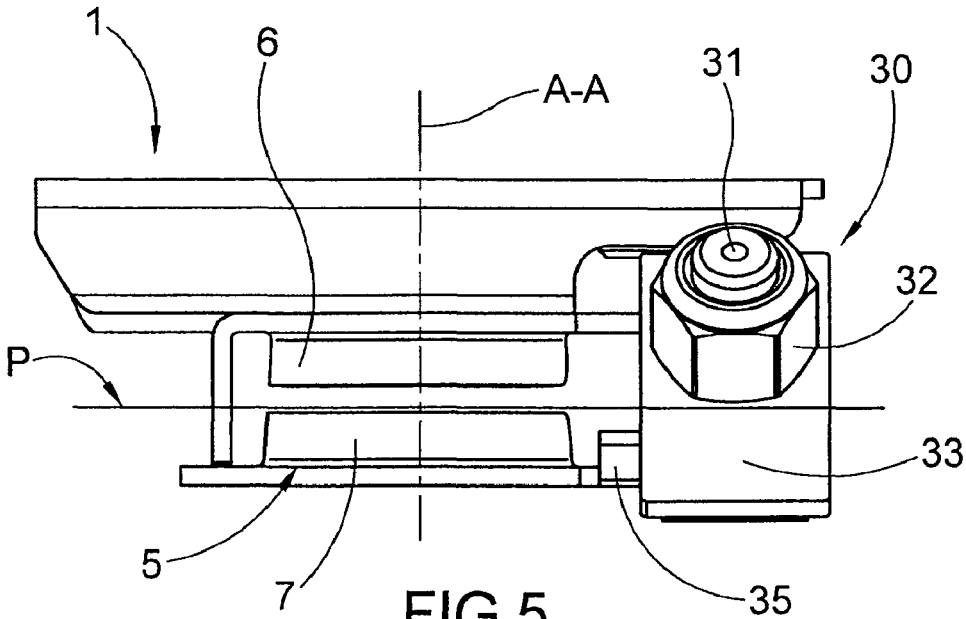
Figure 6:
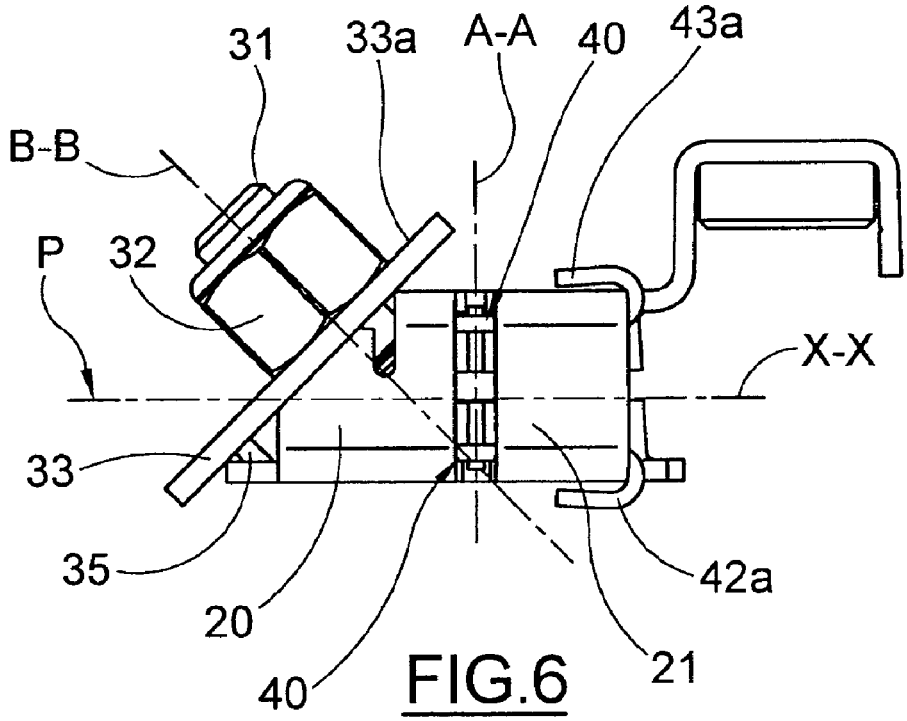
Figure 7:
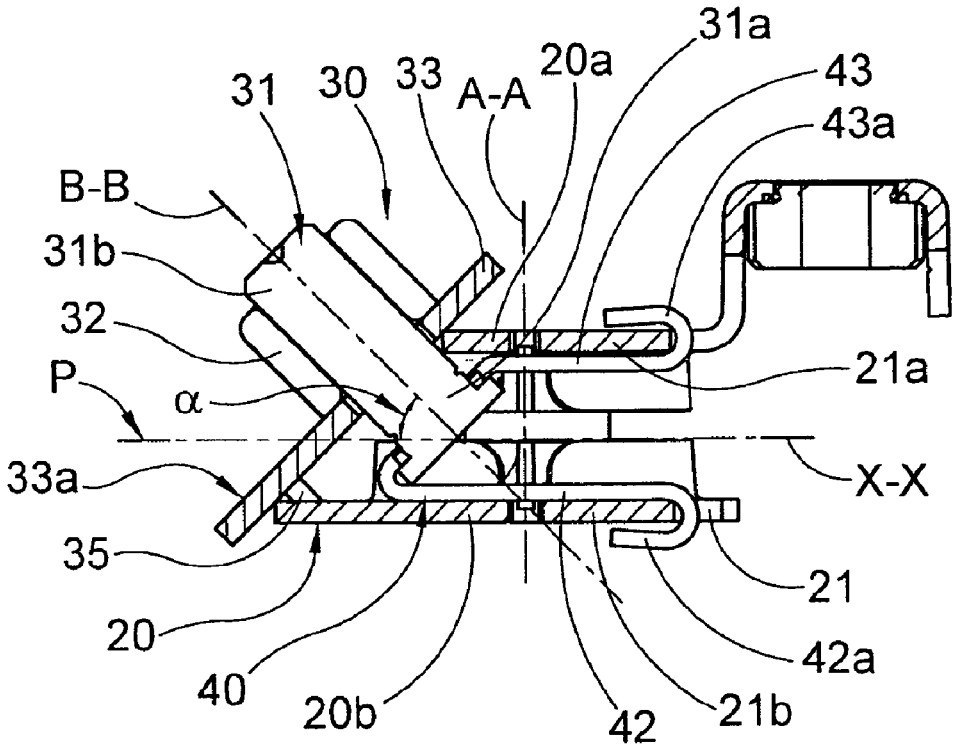
FIG. 7 shows a sectional view of the clamp of FIG. 1.
Figure 8:
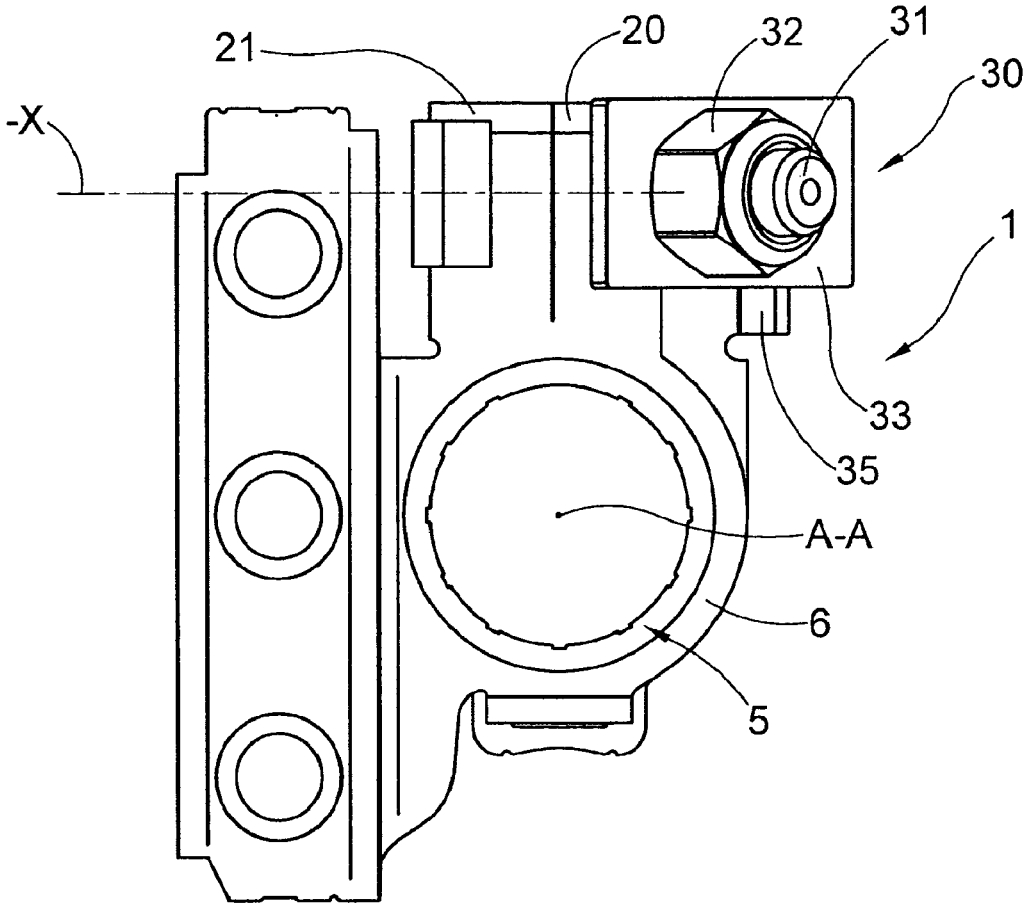
FIGS. 8 to 10 show different flat views of the clamp of FIG. 2.
Figure 9:
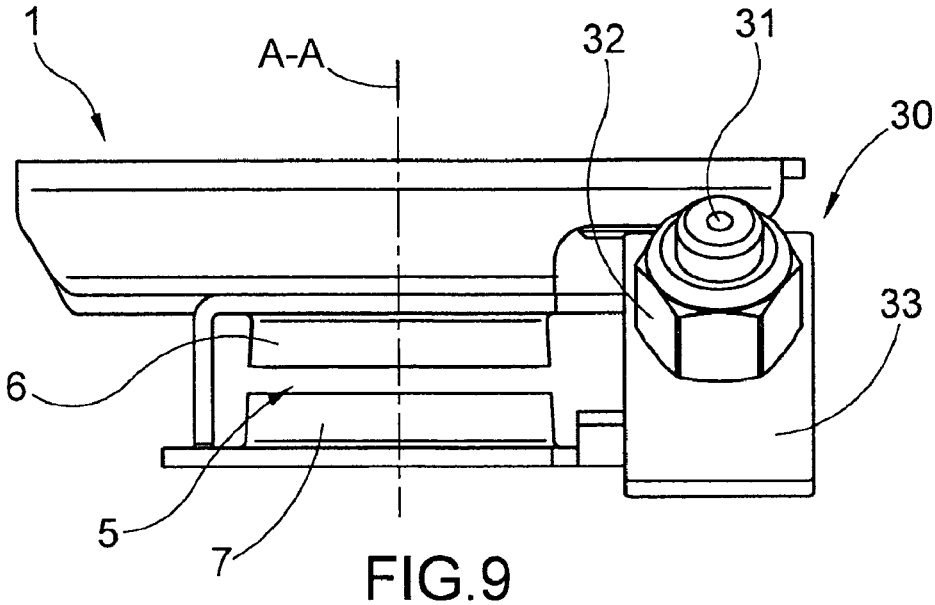
Figure 10:
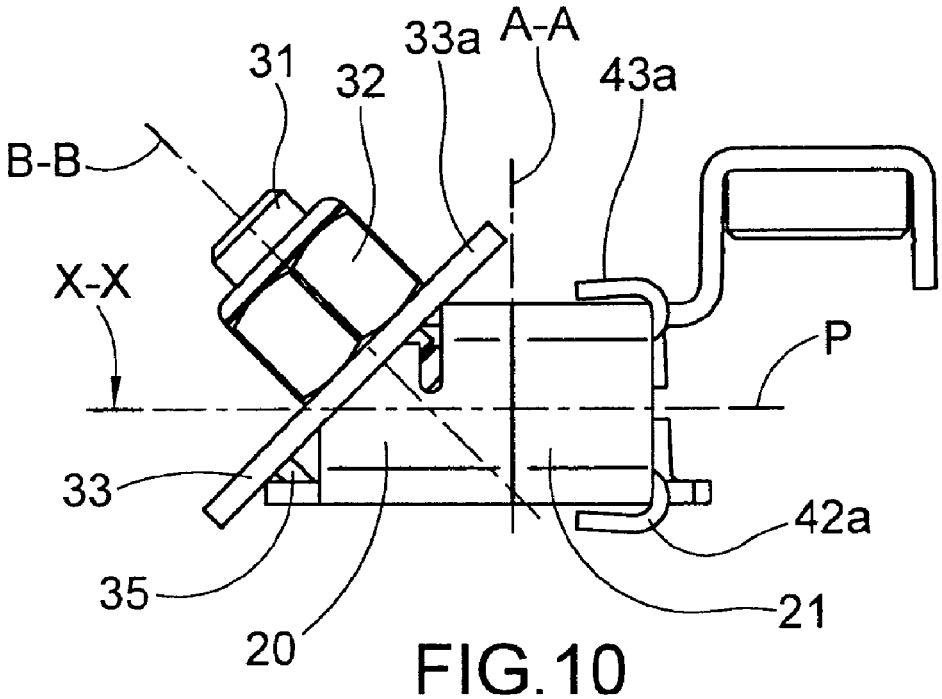
Figure 11:
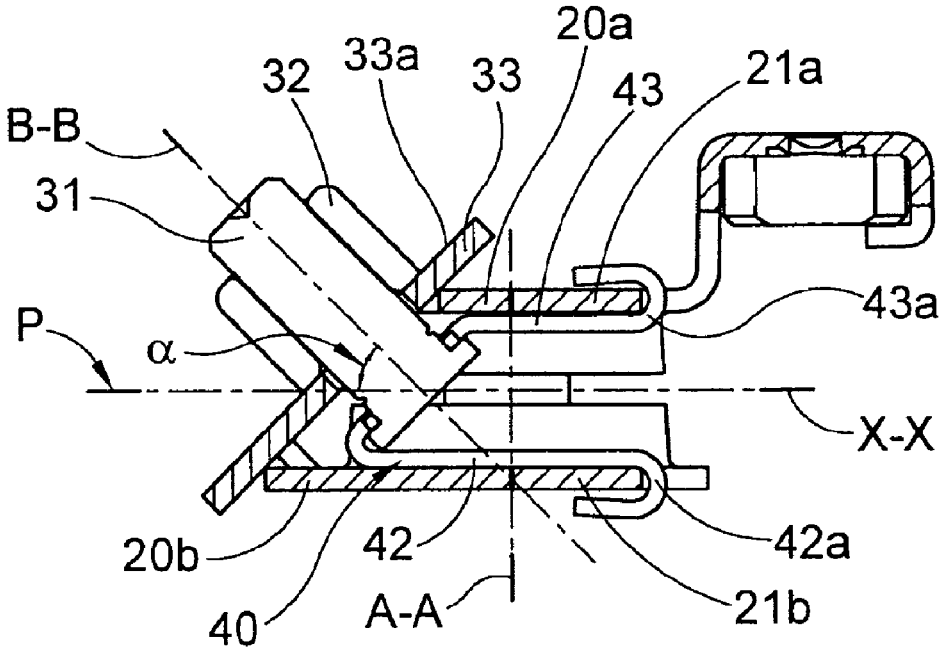
FIG. 11 shows a sectional view of the clamp of FIG. 2.
Figure 12:
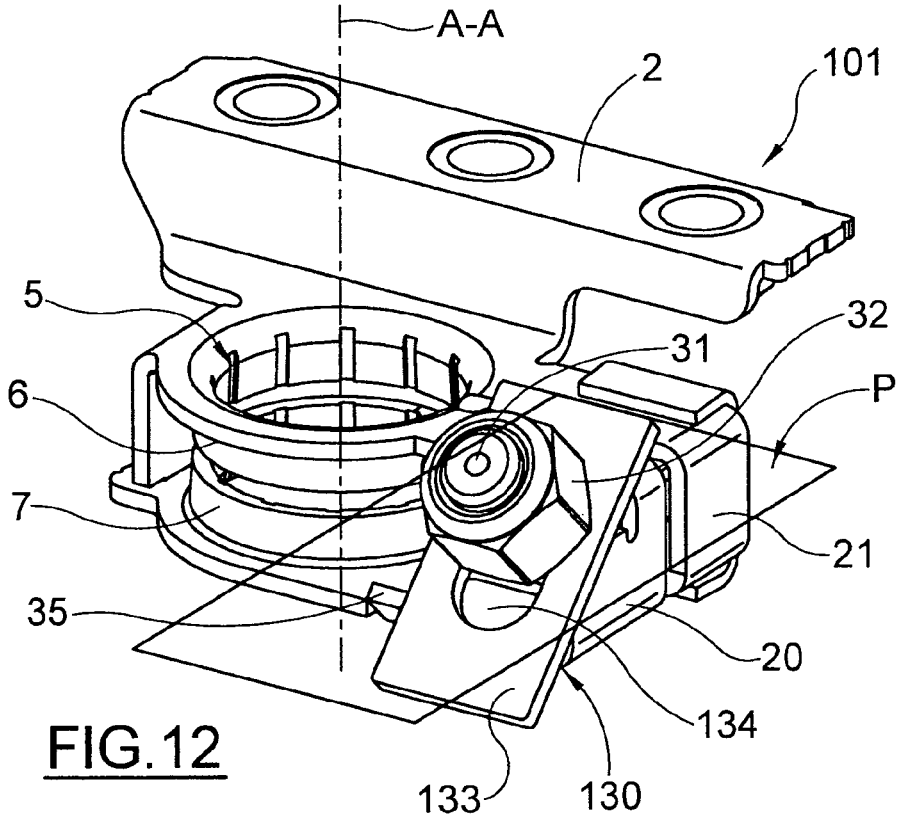
FIG. 12 shows a perspective view of a second embodiment of a clamp according to the present invention, with the jaws in distant position.
Figure 13:
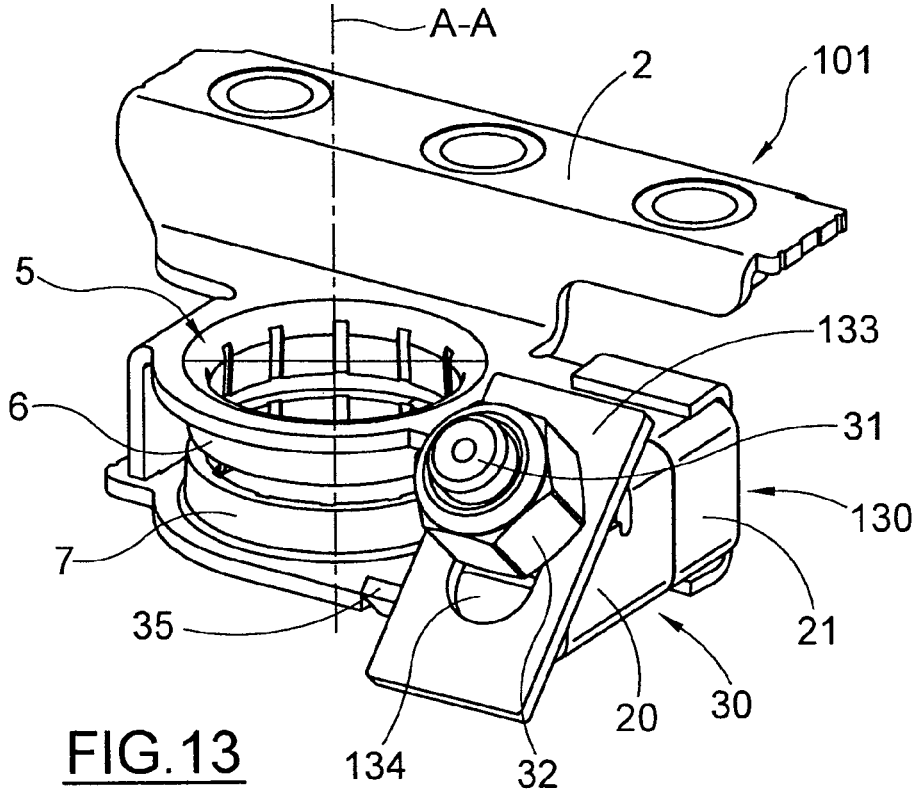
FIG. 13 shows a perspective view of the clamp of FIG. 12, with the jaws in close position.
Figure 14:
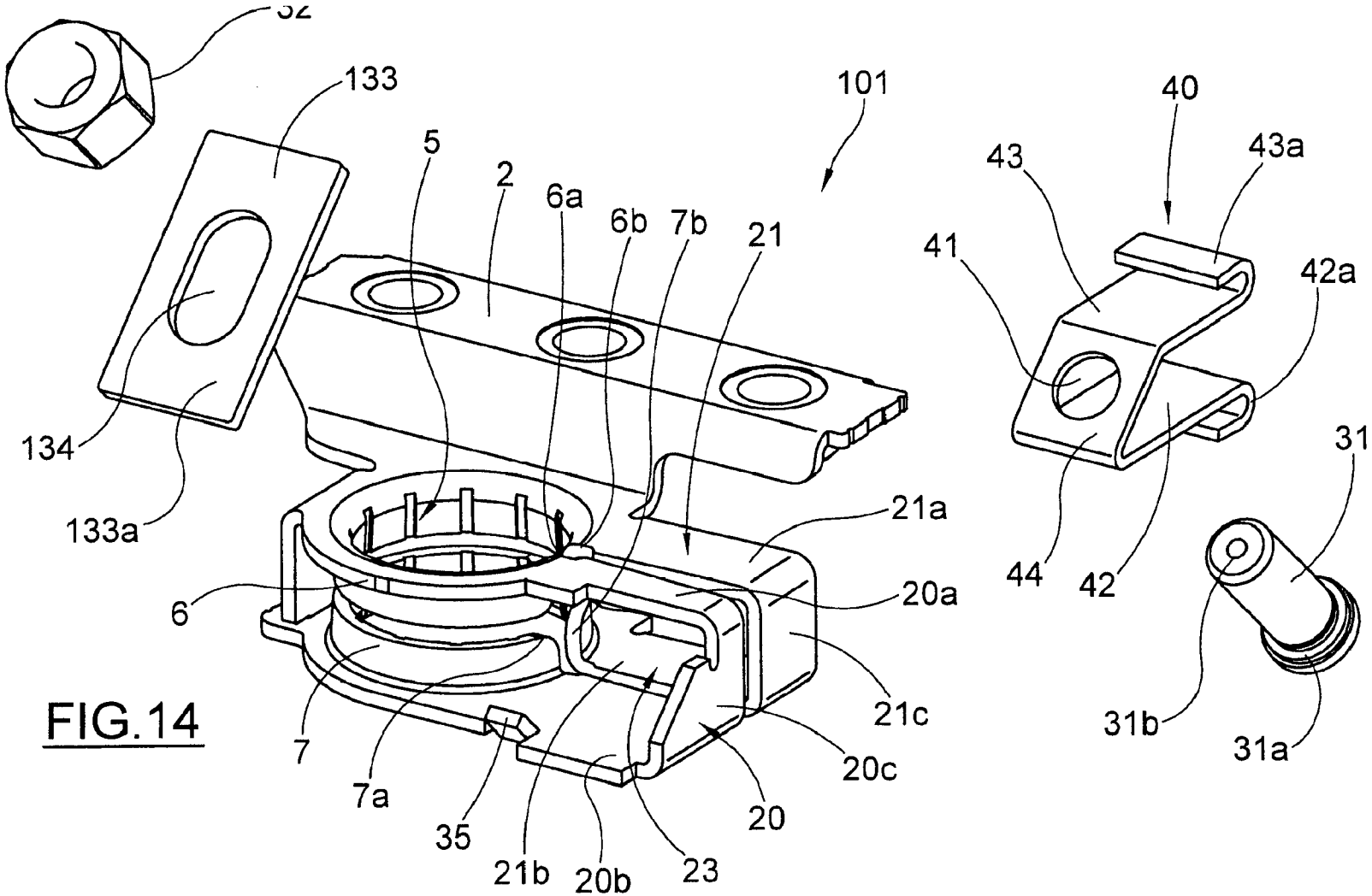
FIG. 14 shows an exploded perspective view of the clamp of FIG. 12.
Figure 15:
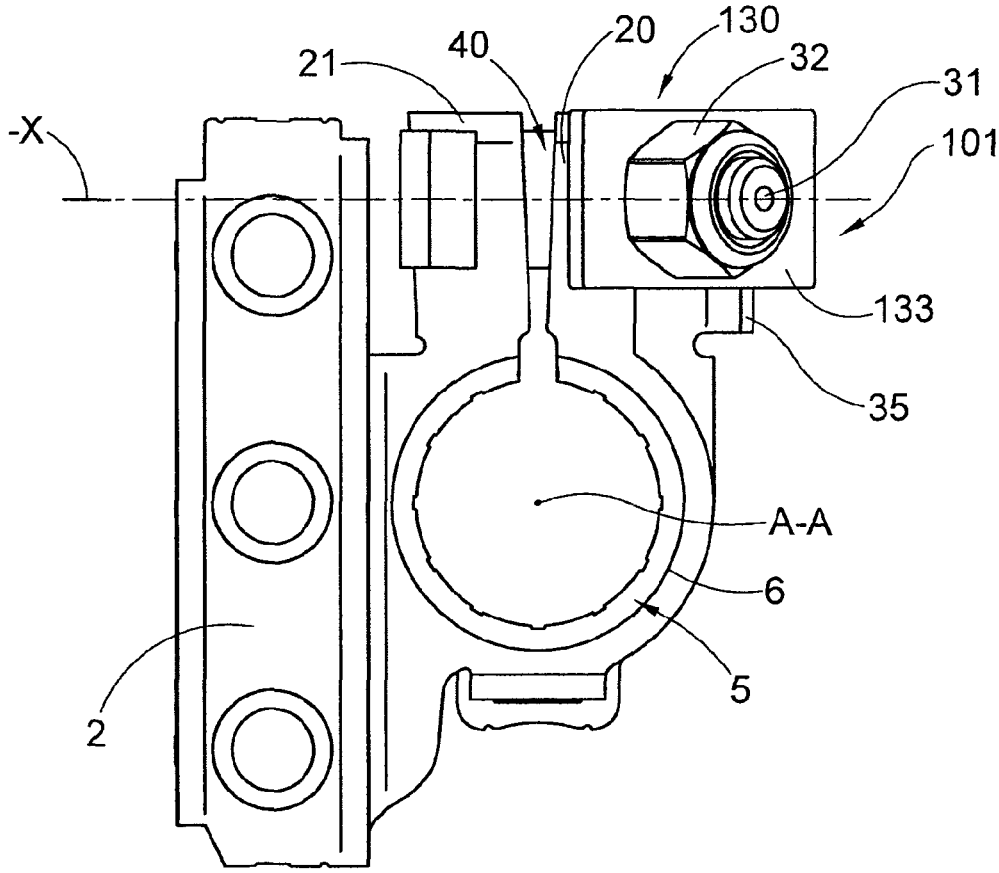
FIGS. 15 to 17 show different flat views of the clamp of FIG. 12.
Figure 16:
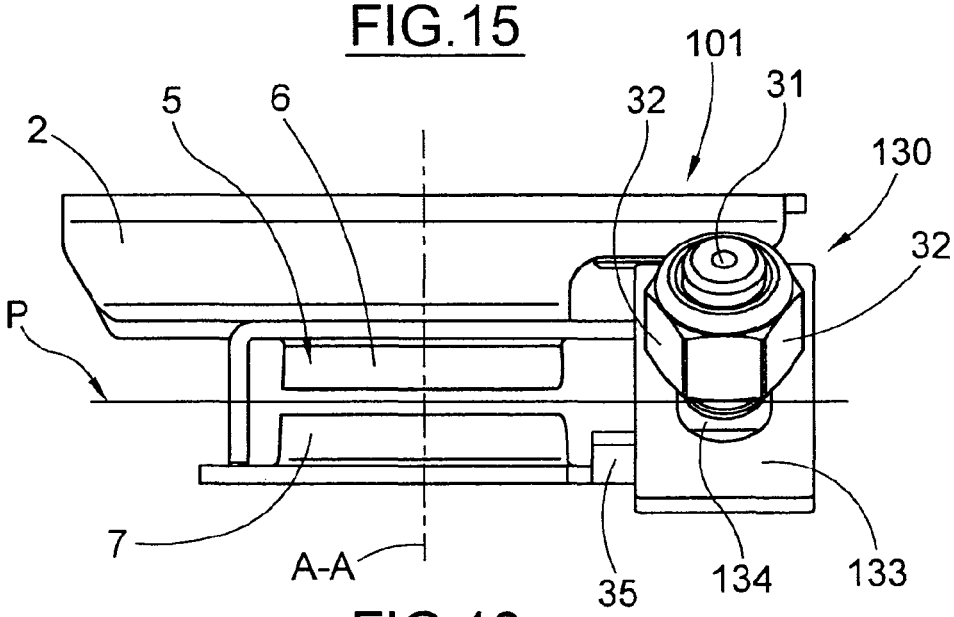
Figure 17:
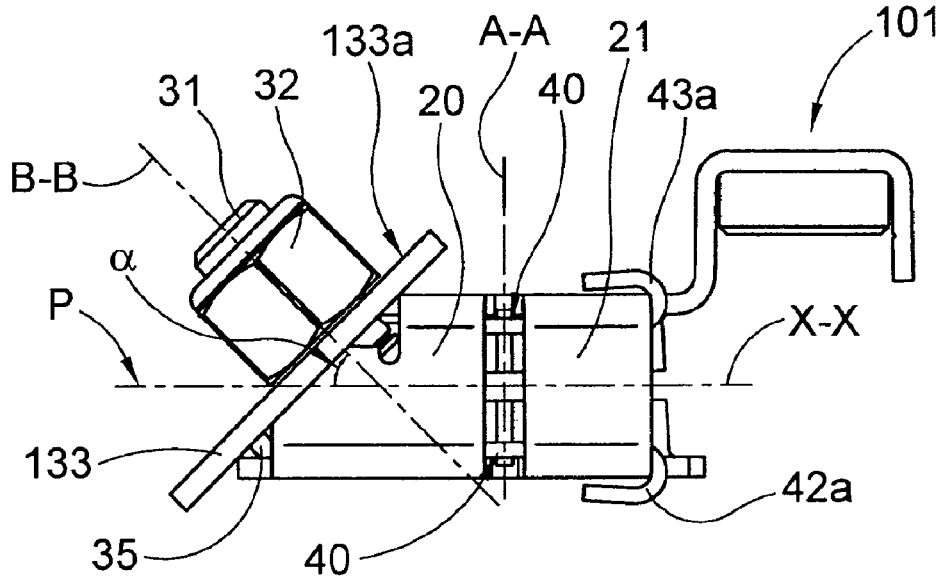
Figure 18:
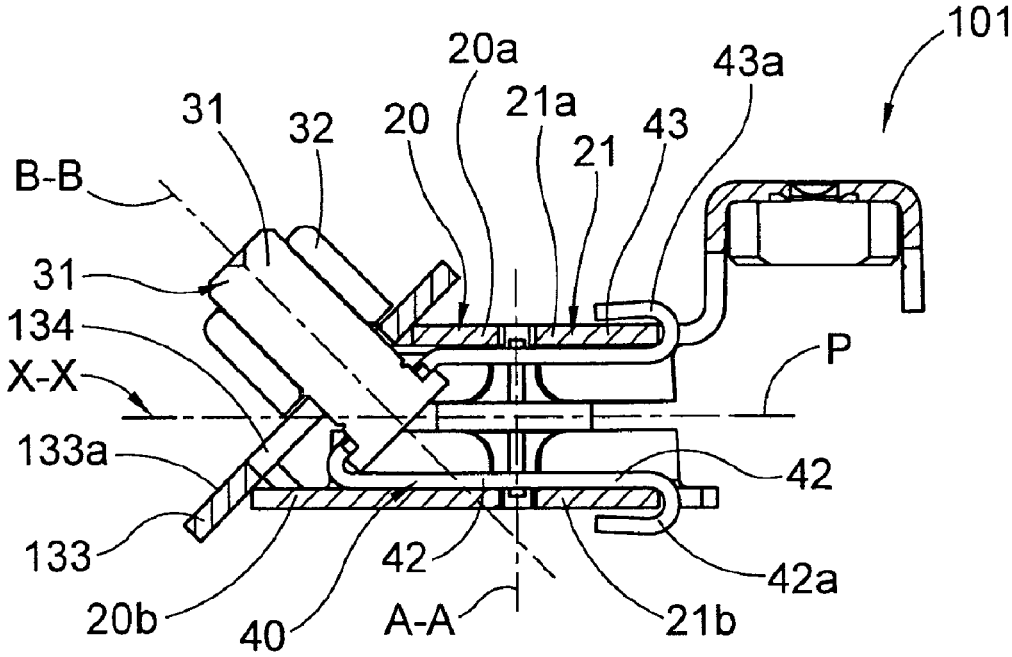
FIG. 18 shows a sectional view of the clamp of FIG. 12.
Figure 19:
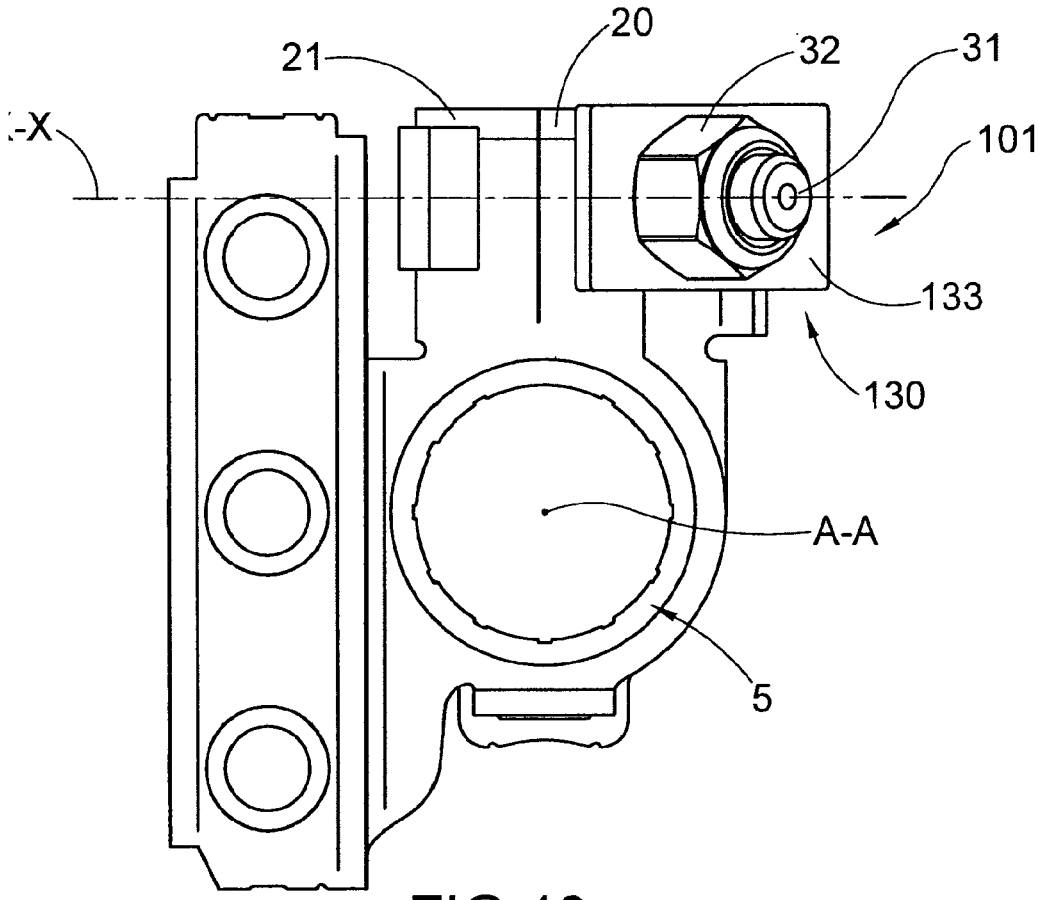
FIGS. 19 to 21 show different flat views of the clamp of FIG. 13.
Figure 20:
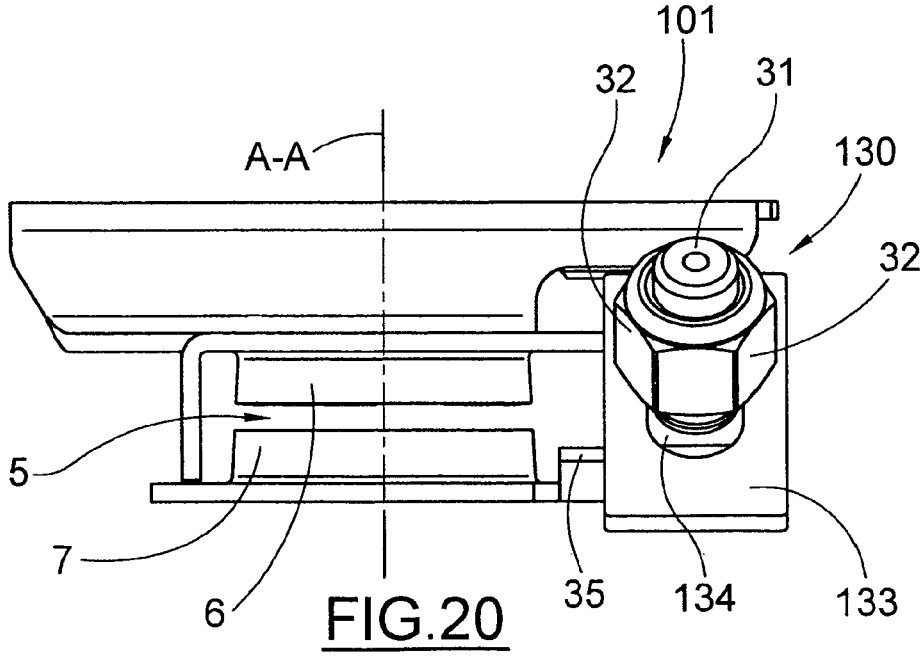
Figure 21:
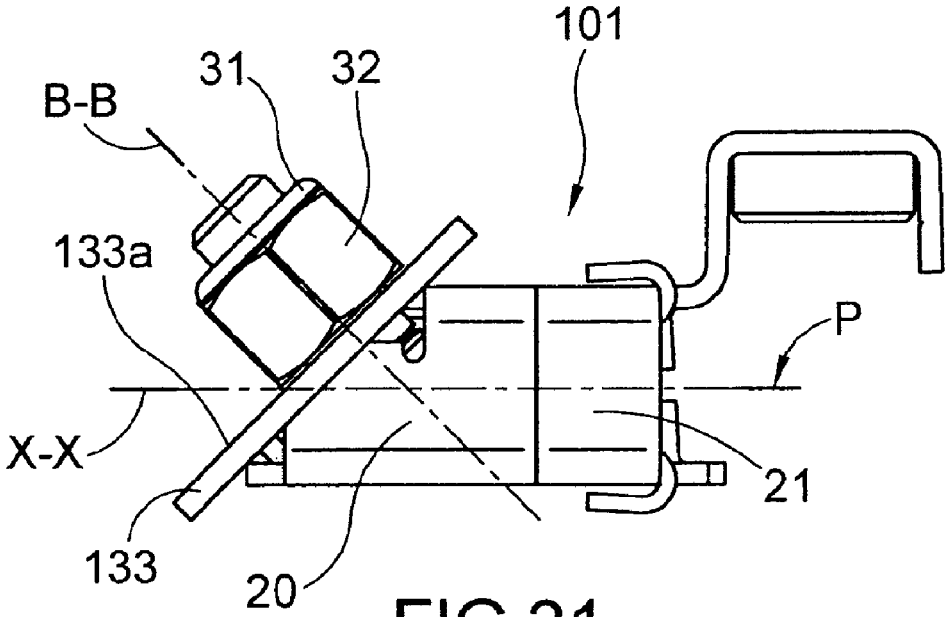
Figure 22:
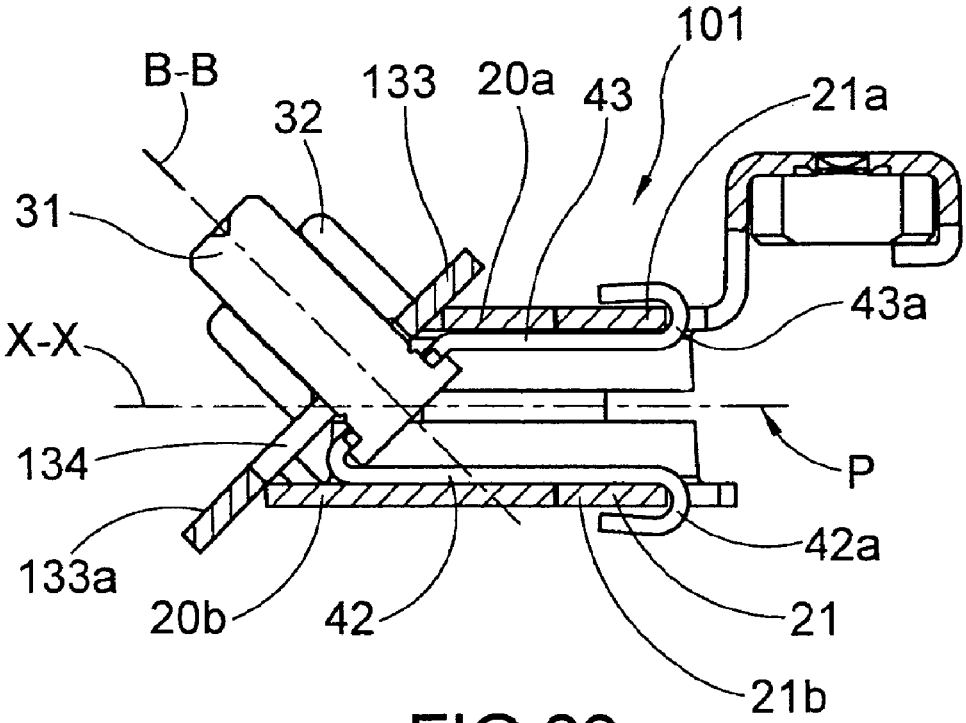
FIG. 22 shows a sectional view of the clamp of FIG. 13.
Figure 23:
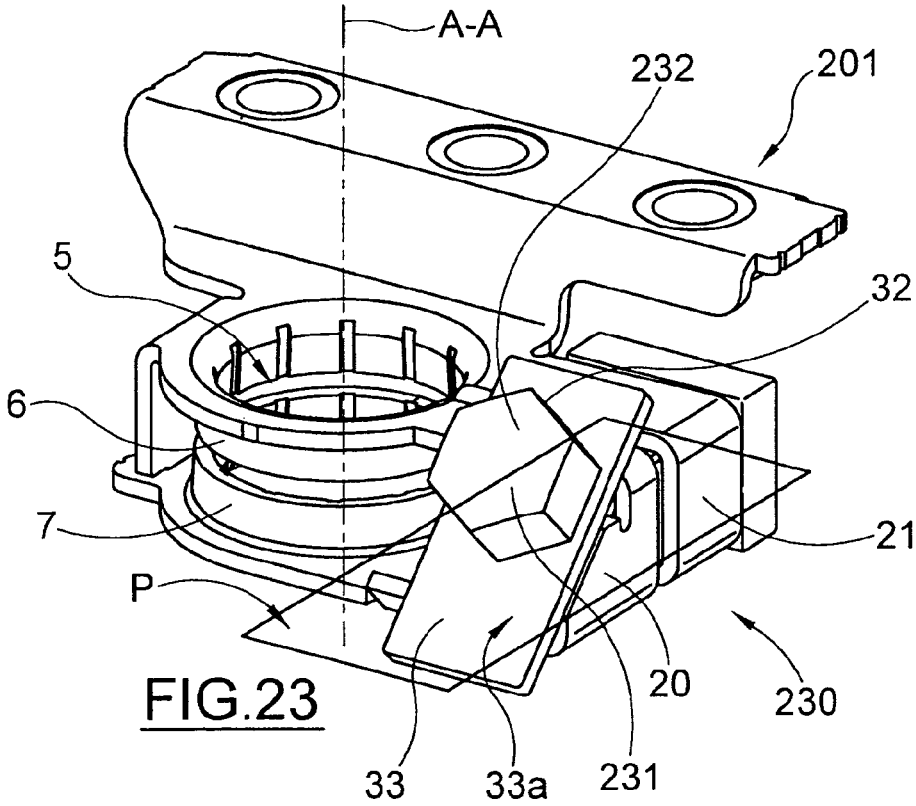
FIG. 23 shows a perspective view of a third embodiment of a clamp according to the present invention, with the jaws in distant position.
Figure 24:
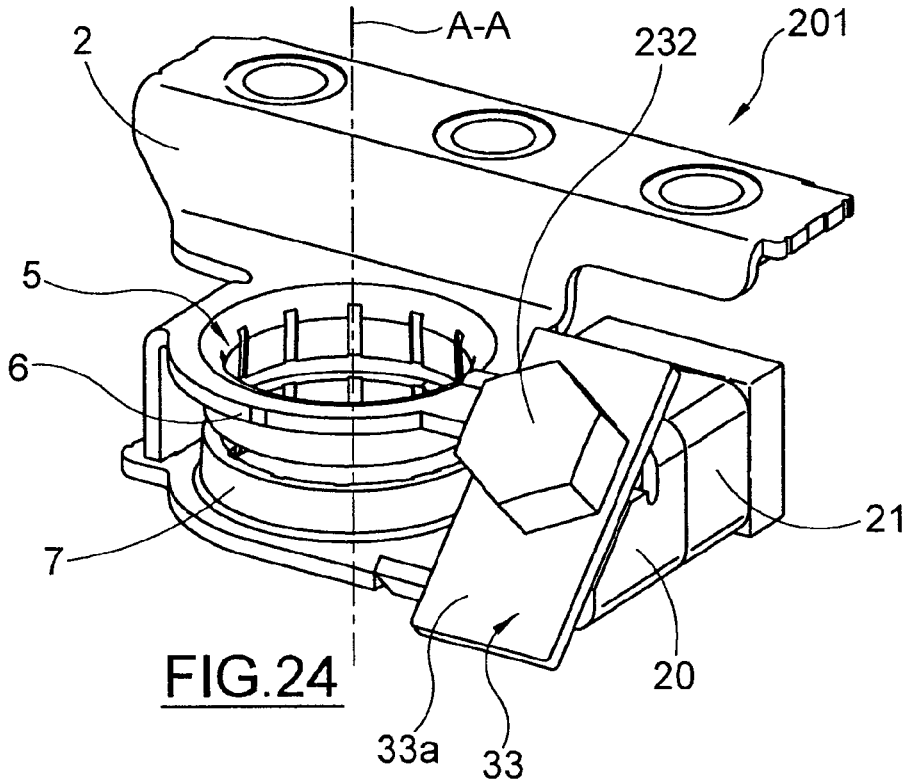
FIG. 24 shows a perspective view of the clamp of FIG. 23, with the jaws in close position.
Figure 25:
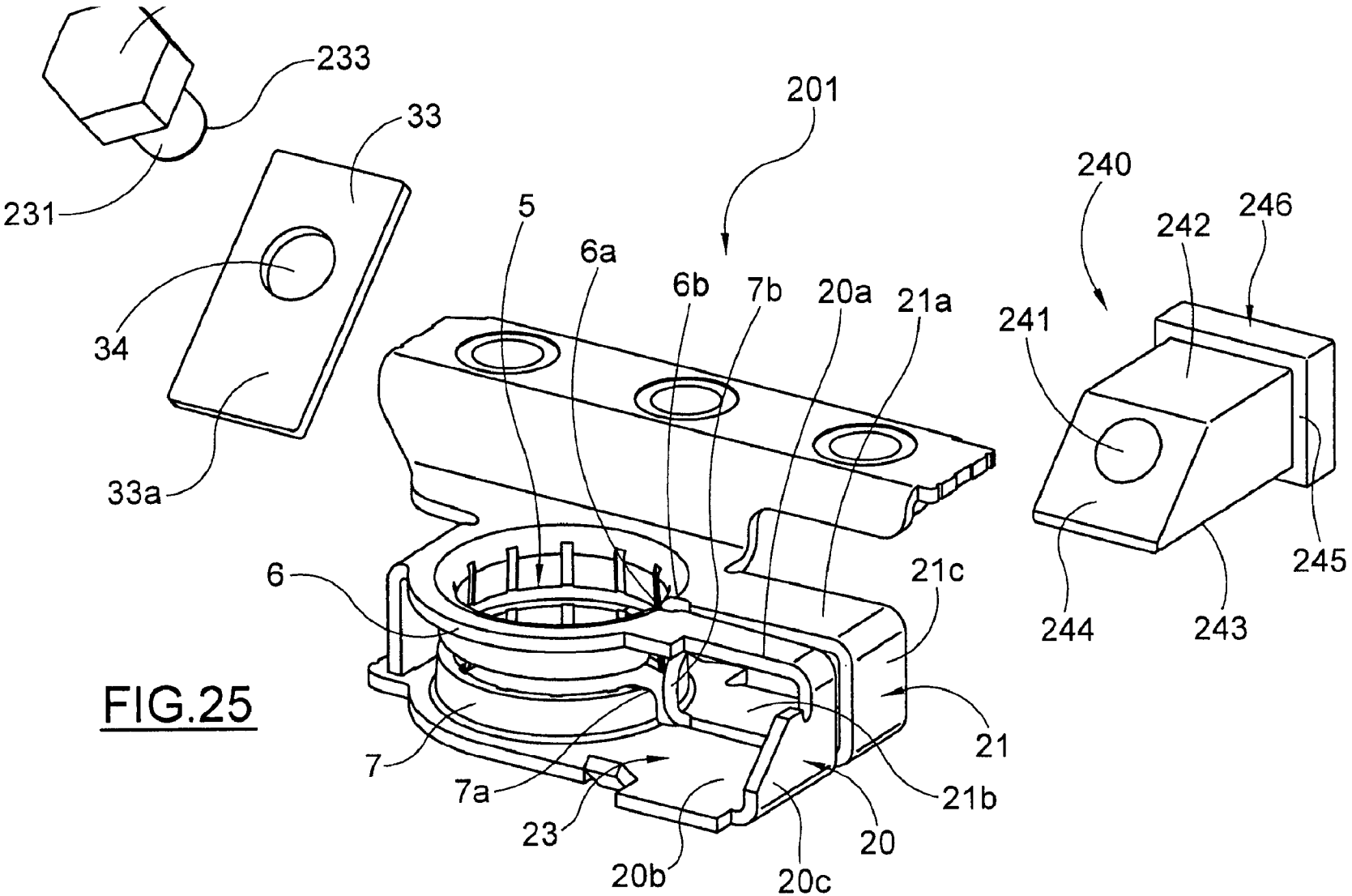
FIG. 25 shows an exploded perspective view of the clamp of FIG. 23.
Figure 26:
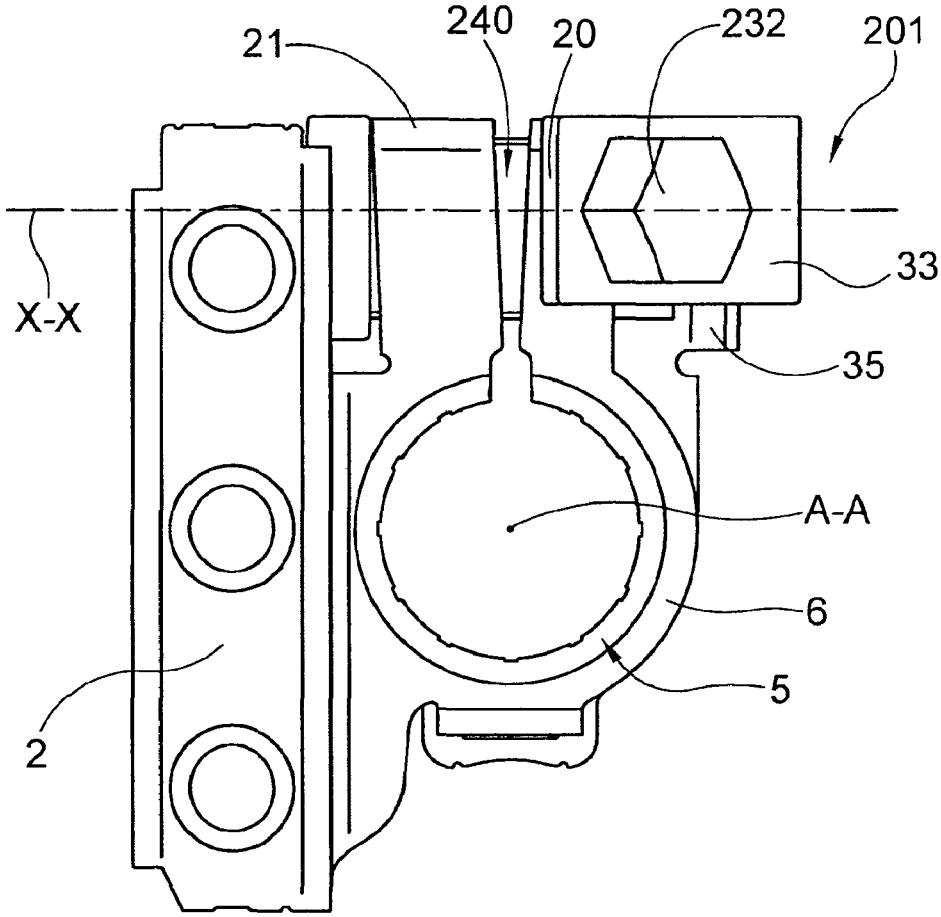
FIGS. 26 to 28 show different flat views of the clamp of FIG. 23.
Figure 27:
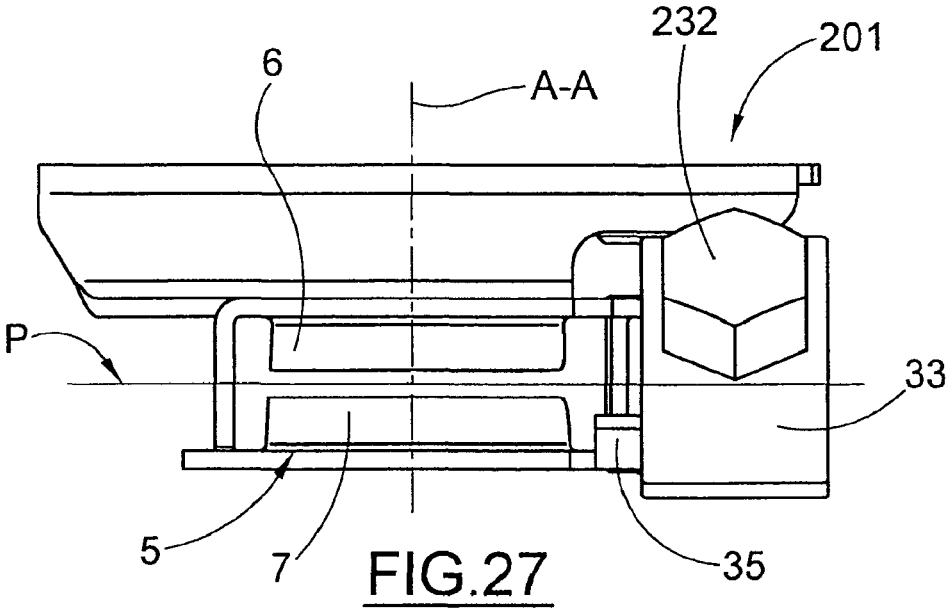
Figure 28:
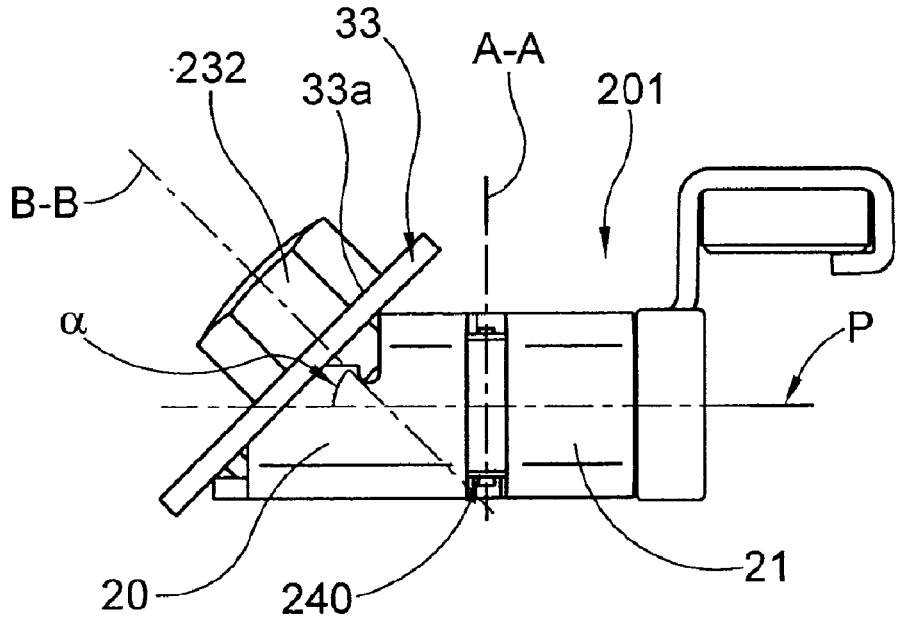
Figure 29:
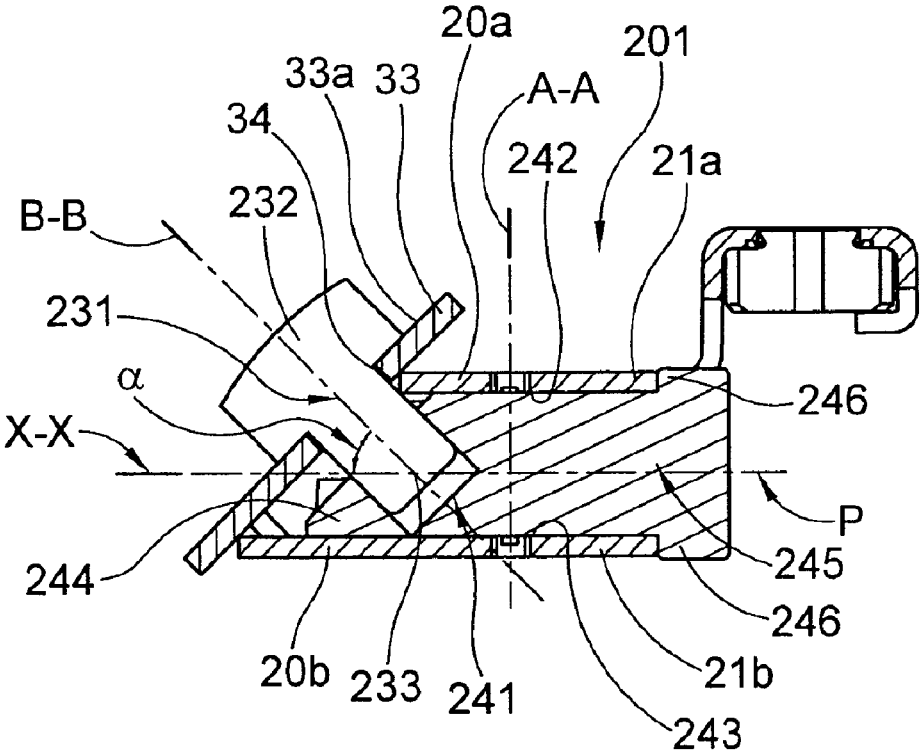
FIG. 29 shows a sectional view of the clamp of FIG. 23.
Figure 30:
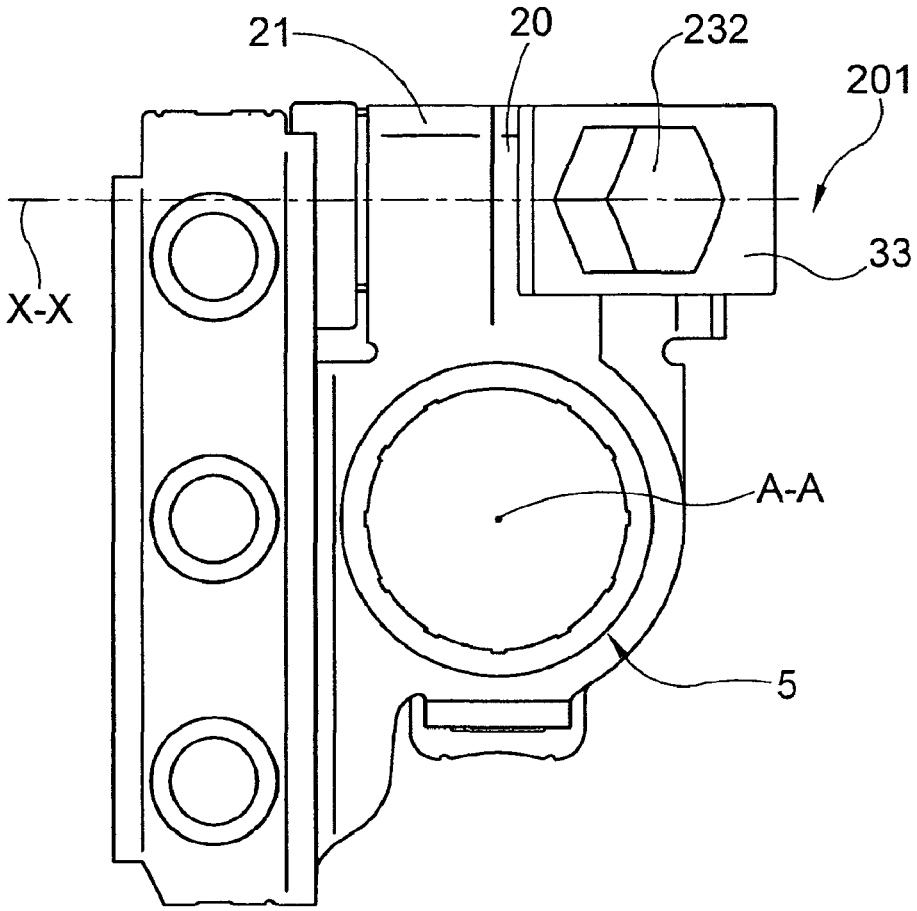
FIGS. 30 to 32 show different flat views of the clamp of FIG. 24.
Figure 31:
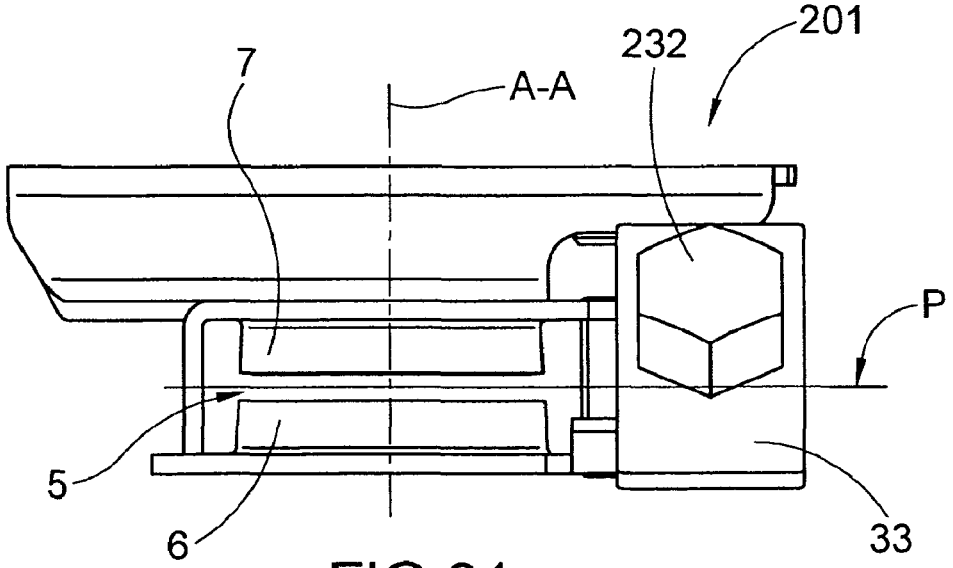
Figure 32:
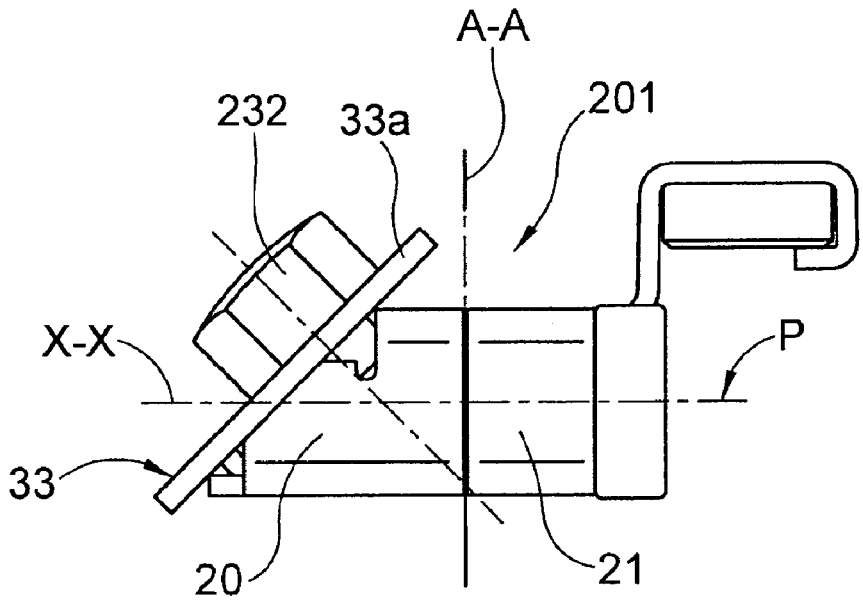
Figure 33:
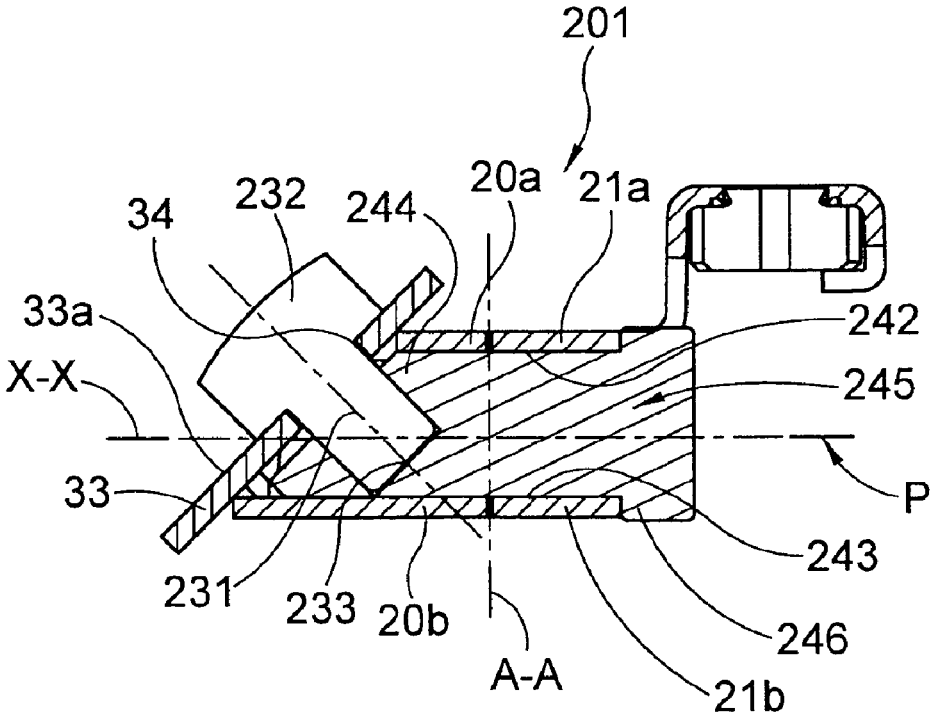
FIG. 33 shows a sectional view of the clamp of FIG. 24.
Figure 34:
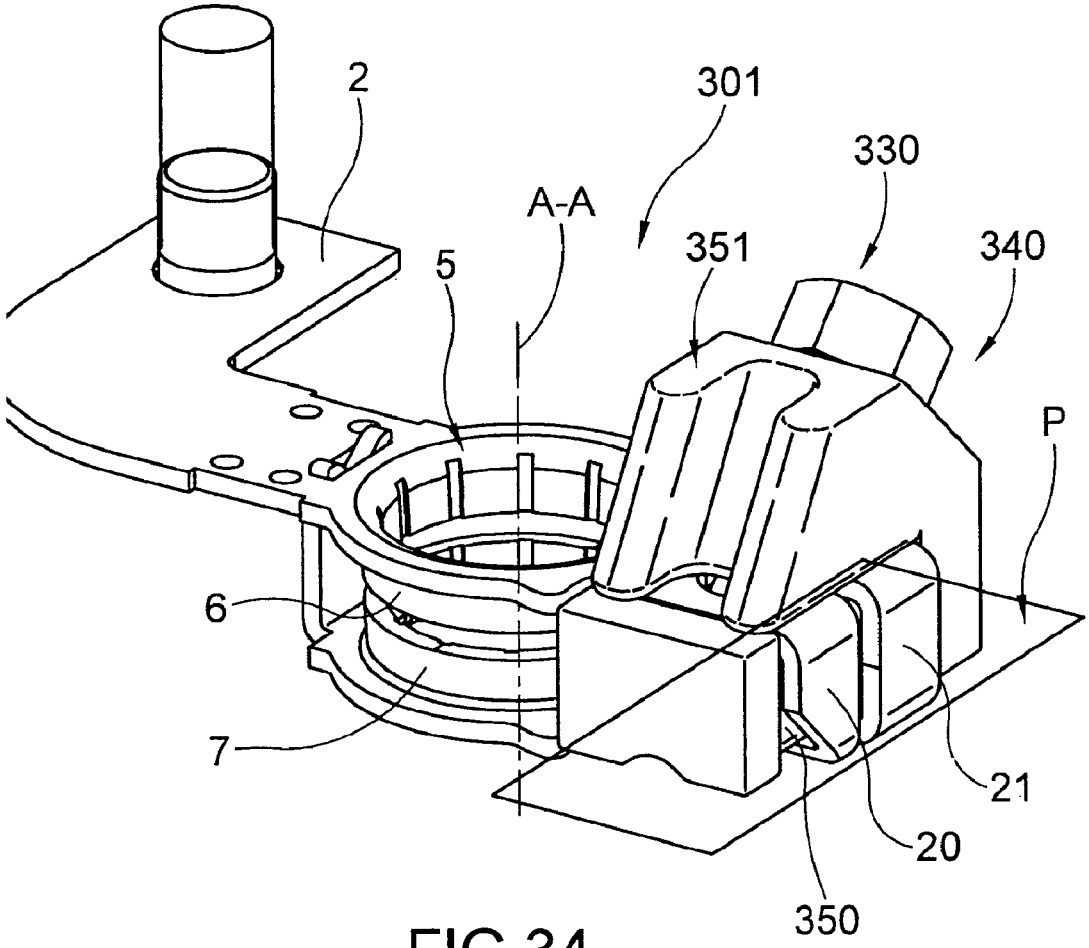
FIG. 34 shows a perspective view of a forth embodiment of a clamp according to the present invention.
Figure 35:
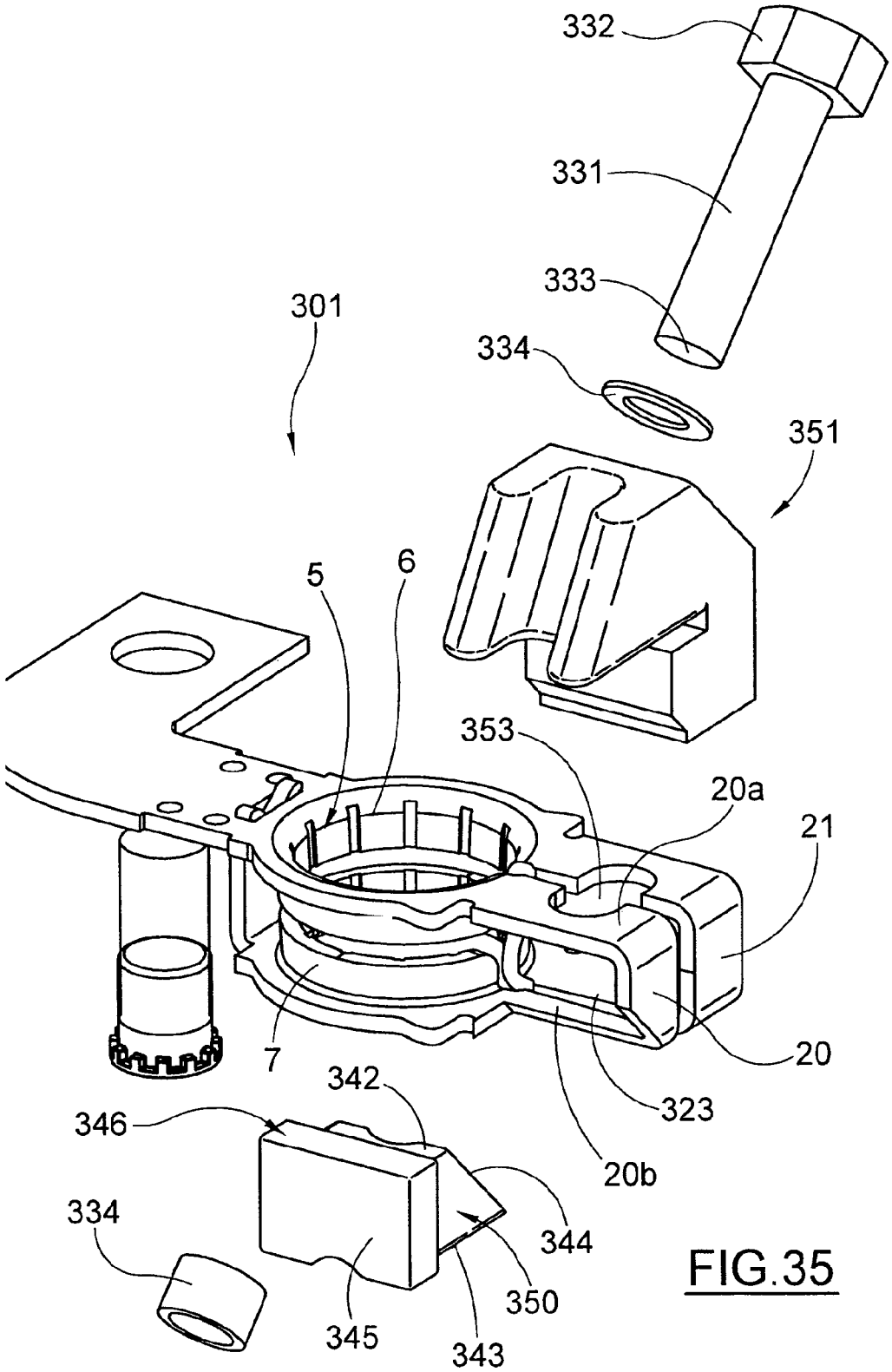
FIG. 35 shows an exploded perspective view of the clamp of FIG. 34.
Figure 36:
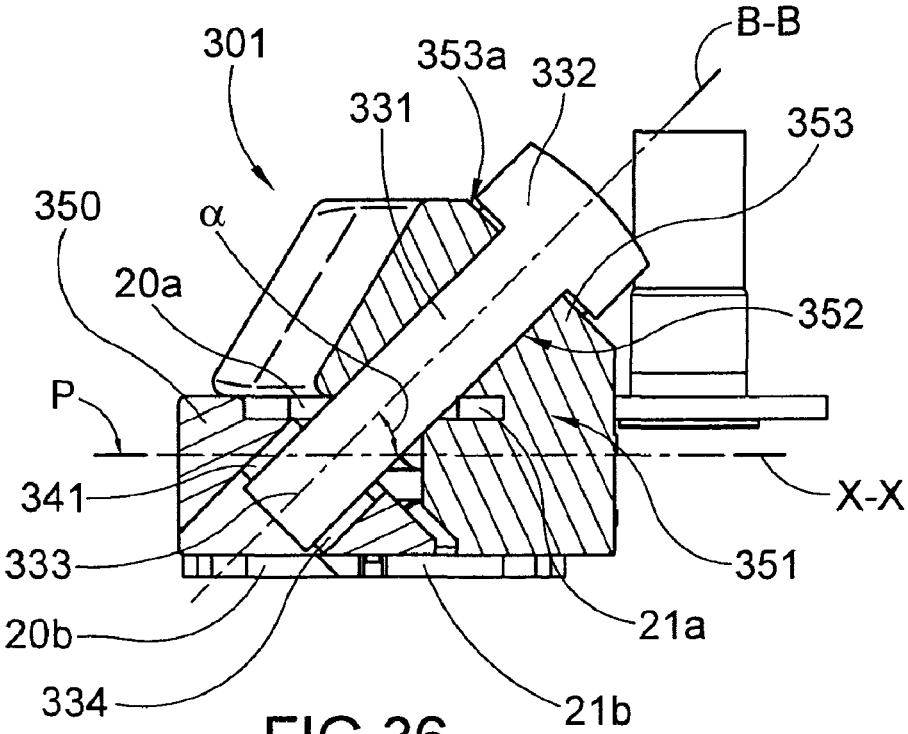
FIG. 36 shows a sectional view of the clamp of FIG. 34, with the jaws in distant position.
Figure 37:
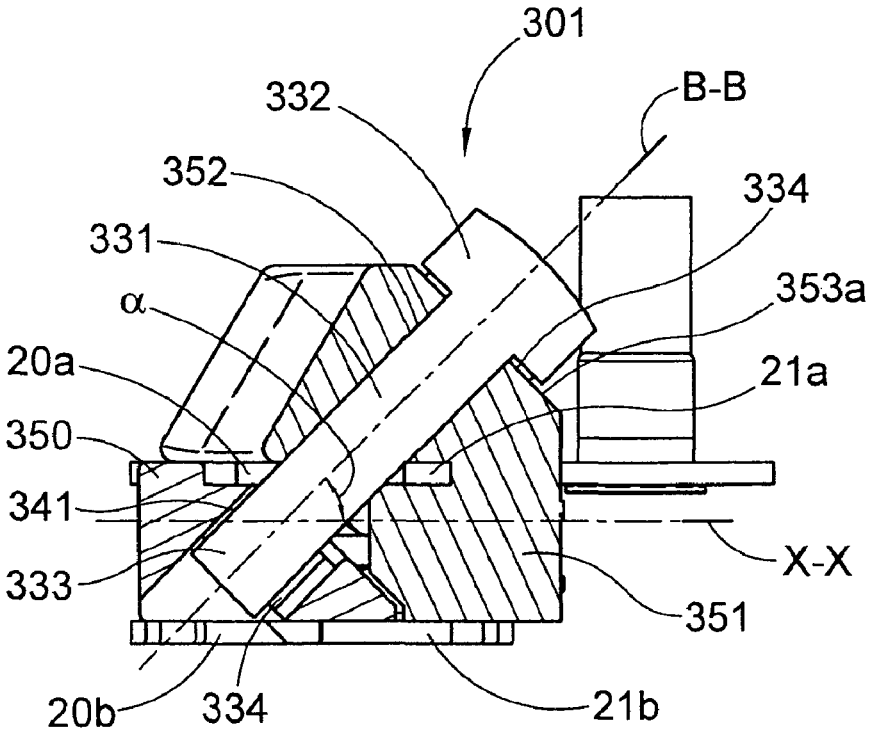
FIG. 37 shows a sectional view of the clamp of FIG. 34, with the jaws in close position.

Referring to the annexed figures, numeral 1 generally designates a clamp according to the present invention.

The clamp 1 comprises a support element 2, a conductive body 3 and clamping means 30.

According to the embodiment shown in the annexed figures, the conductive body 3 is formed by punching, coining and bending starting from a plate of an electrically conductive material, such as brass or copper alloy having high electrical conductivity and good mechanical strength together with a good ductility. Alternatively, the conductive body can be a melt alloy block or of a different kind.

The conductive body 3 comprises a clamping ring 5 having an axis A-A. This clamping ring 5 is capable of inserting on a male terminal (not shown in the annexed figures) in an insertion direction extended along said axis A-A. Hereinafter a battery terminal will be referred to, without limitation, it being understood that the clamp of the present invention can be used on any male terminals.

According to the embodiment shown in the figures, the clamping ring 5 comprises an upper open ring 6 and a lower open ring 7 having two opposed end portions, 6*a*, 6*b* and 7*a*, 7*b* respectively, mutually approachable to tighten the clamping ring 5 around the battery terminal, when the clamp 1 is mounted on the battery terminal. Each open ring 6, 7 is made of two opposed arms 6', 6" and 7', 7" which terminate at the end portions 6*a*, 6*b* and 7*a*, 7*b*.

The conductive body 3 is obtained starting from a plate (not shown in the figures) which is folded so that the lower ring 7 places itself under the upper ring 6, parallel to it and axially aligned thereto.

The clamp 1 comprises a first jaw 20 and a second jaw 21, connected to the clamping ring 5 and mutually approachable to tighten the clamping ring 5 on the battery terminal. In particular, at least one of the two jaws 20, 21 is movable.

In the examples shown in FIGS. 1 to 37, the jaw 20 is movable while the jaw 21 is fixed. In particular, the jaw 20 is movable from and toward the jaw 21.

In the examples shown in FIGS. 38 to 43, the jaw 21 is movable while the jaw 20 is fixed. In this case, the jaw 21 is movable from and toward the jaw 20.

Alternatively, the two jaws 20, 21 can be both movable.

The first jaw 20 is integral with the end portions 6*a*, 7*a* while the second jaw 21 is integral with the end portions 6*b*, 7*b*.

According to one embodiment, the upper ring 6 and the lower ring 7 are linked up together through the two jaws 20, 21. In particular, the jaw 20 comprises an upper wall 20*a* linked up to the upper end 6*a* of ring 6, a lower wall 20*b* linked up to the lower end 7*a* of the ring 7 and a side wall 20*c* linking up the upper wall 20*a* and lower wall 20*b* on opposite side of the rings 6, 7. In the same way, the jaw 21 comprises an upper wall 21*a* linked up to the upper end 6*b* of the ring 6, a lower wall 21*b* linked up to the lower wall 7*b* of the ring 7 and a side wall 21*c* linking up the two upper 21*a* and lower 21*b* walls from opposite side of the rings 6, 7.

The walls 20*a*, 20*b*, 20*c* and 21*a*, 21*b*, 2*c* define a housing 23, extended along the direction X-X, whose function will be described in details hereinafter.

The clamping means 30 act on the two jaws 20, 21 to move said jaws 21, 22 between a distant position and a close position along a clamping direction X-X to tighten the clamping ring 5 on the battery terminal 10.

The clamping means 30 comprise a clamping member that rotates around a clamping axis B-B to move the jaws 20, 21 between a distant position and a close position. In particular, the clamping axis B-B is inclined with respect to a plane P perpendicular to axis A-A of the clamping ring 5 so as to create with plane P an angle $\alpha$ different from the right angle.

Preferably, angle $\alpha$ ranges between 15° and 75°. More preferably, angle $\alpha$ ranges between 30° and 60°. Still more preferably, angle $\alpha$ is about 45°.

The clamp 1 further comprises guiding means 40 cooperating with the movable jaw, in FIGS. 1 to 37 with the movable jaw 20, to guide the movement of this jaw along the clamping direction X-X on plane P between the distant position and the close position. Since the movement of the movable jaw occurs on plane P perpendicular to the clamping ring axis, the tightening of the two jaws 20, 21 takes place on this plane P without any torsions on the jaws 20, 21 and on the clamping ring 5.

According to the embodiment shown in the annexed figures, the guiding means 40 cooperate with both the two jaws 20, 21 to guide the movement of the two jaws 20, 21 on plane P.

Advantageously, the guiding means 40 also cooperate with the clamping means 30 to guide the movement of the two jaws 20, 21 on plane P.

According to one embodiment, the guiding means 40 comprise a slider connected to the clamping member and equipped with engaging means to engage one of the two jaws.

Advantageously, the engaging means 30 are of the screw-nut screw type. In particular, the screw is coupled with the guiding means 40 while the nut screw engages the clamping plate 33 or vice versa.

According to one embodiment, the clamping means 30 comprise a clamping surface 33*a* lying on a plane perpendicular to the clamping axis B-B and the rotatable clamping member acts thereon to move the jaws 20, 21 between the distant position and the close position.

In the examples shown in the annexed figures, the clamping surface 33*a* is provided by a clamping plate 33 interposed between the rotatable clamping member and the jaw 20. In particular, the clamping plate 33 abuts against an end of the lower wall 20*b* and of the upper wall 20*a* of the jaw 20. Alternatively, in the example shown in FIGS. 41 to 43, the clamping surface 33*a* can be provided by a connection wall between the upper wall 20*a* and the lower wall 20*b* of the jaw 20.

The clamping plate 33 can have a rectangular shape, as shown in the figures, or a circular shape, like a common washer.

In the case of a rectangular clamping plate 33, the clamp 1 can be advantageously equipped with an anti-rotation element 35 engaged with one side of the clamping plate 33 in order to prevent the rotation of the plate 33 due to the rotation of the rotatable clamping member.

According to a first embodiment shown in FIGS. 1 to 11, the clamping means 30 comprise a clamping screw 31 extended along the clamping axis B-B, secured, at one end 31*a*, to the guiding means 40 and having an opposite free end 31*b*. In order to simplify the overall representation of the clamp, the clamping screw shown in the annexed figures is schematized without thread. However, it is understood that this clamping screw has a thread (not shown in the figures).

The slider 40 has an opening 41 for securing the end 31*a* of the clamping screw 31. The securing of the clamping screw 31 to the slider 40 can be carried out by inserting the base 31*a* of the clamping screw 31 by interference into the hole 41. Alternatively, other means for securing the clamping screw 31 to the slider 40 can be used.

The rotatable clamping member is made of a clamping nut 32 mounted as rotating on the clamping screw 31 on the side of the free end 31*b* and it engages the clamping plate 33 to move the jaws 20, 21 between the close position and the distant position. In particular, the rotation of the clamping nut 32 with respect to the clamping screw 31 around the clamping axis B-B causes the movable jaw 20 to move along the direction X-X on plane P between the distant position and the close position.

The clamping screw 31 cooperates one of the two jaws 20, 21, in the example with the fixed jaw 21. In particular, the clamping screw 31 is connected to the guiding means 40 which are engaged with the jaw 21 so as to have the clamping screw 31 cooperate with the jaw 21.

The slider 40 comprises two plaques 42, 43 each parallel to the other and connected by a plaque 44 in which an opening 41 is derived to secure the end 31*a* of the clamping screw 31. The plague 44 lies on a plane perpendicular to the clamping axis B-B and therefore parallel to the plane on which the surface 33*a* of the clamping plate 33 lies.

On opposite side of the plaque 44, the two plaques 42, 43 have respective hooking means 42*a*, 43*a* to allow the engaging of the slider 40 with the jaw 21.

In the example, the hooking means 42*a*, 43*a* are represented by two tongues folded so as to engage the upper wall 21*a* and the lower wall 21*b* of the jaw 21.

In particular, in order to guide the movement of the jaws 20, 21 on plane P, the plaques 42 and 43 lie on respective planes parallel to plane P, i.e., on planes perpendicular to the axis A-A of the clamping ring and engage respective upper 20*a*, 21*a* and lower 20*b*, 21*b* walls of the two jaws 20, 21 to guide the jaws 20, 21 in their movement on plane P.

Advantageously, the slider 40 is nested inside the housing 23 defined by the two jaws 20, 21.

The clamping plate 33 has an opening 34 for the passage of the clamping screw 31.

As shown in FIGS. 1 to 37, the plate 33 abuts against jaw 20 so as to be able to slide with respect to the clamping screw 31 along the clamping axis B-B of the clamping screw 31 but without the possibility of a relative movement along the plane of plate 33. To this purpose, the opening 34 for the passage of the clamping screw 31 is configured so as to allow the plate 33-clamping screw 31 relative movement along the clamping axis B-B and prevents plate 33 to move on the plane perpendicular to said axis B-B. In the example, the diameter of the opening 34 substantially corresponds to the diameter of the clamping screw 31. Advantageously, the opening 34 has a thread able to couple to the thread of the clamping screw 31.

Starting from a configuration in which the jaws 20,21 are in a distant position (FIGS. 4-7), the tightening of the clamp 1 is carried out by rotating the clamping nut 32 on the clamping screw 31. The rotation of the nut 32 causes a relative movement of the nut 32 with respect to the clamping screw 31 along its axis B-B and a corresponding relative movement of plate 33 with respect to the clamping screw 31 along axis B-B. Since the plate 33 is kept abut against jaw 20 by the clamping nut 32 and the movable jaw 20 is guided by the guiding slider 40 which forces it to move on plane P, the jaw 20 moves on this plane P from the distant position (FIGS. 4-7) to the close position (FIGS. 8-11) to tighten the clamping ring 5 on a battery terminal.

According to a second embodiment shown in FIGS. 12 to 22, showing a clamp 101, the opening 134 in the clamping plate 133 for the passage of the clamping screw 31 is an elongated housing slot. It is useful to notice that the elements of this embodiment corresponding to the ones of the first embodiment are referred to with the same numerals. In this case, the slot 134 is configured so as to allow the plate 133-clamping screw 31 relative movement of the clamping means 130 not only along the clamping axis B-B but also along the clamping direction X-X. On the other hand, since the plate 133 with clamping surface 133*a* works on the movable jaw 20, the clamp 101 tightening occurs as described with reference to the clamp 1 of FIGS. 1 to 11. In particular, the rotation of the nut 32 causes a relative movement of the nut 32 with respect to the clamping screw 31 along its axis B-B and a corresponding relative movement of the plate 133 with respect to the clamping screw 31 along axis B-B. Since the plate 133 is kept abut against the jaw 20 and the movable jaw 20 is guided by the guiding slider 40 which forces it to move on plane P, the jaw 20 moves on this plane P from the distant position (FIGS. 15-18) to the close position (FIGS. 19-22) to tighten the clamping ring 5 on a battery terminal.

According to a third embodiment shown in FIGS. 23 to 33, showing a clamp 201, the rotatable clamping member of the clamping means 230 comprises a clamping screw 231 having a portion 232 to drive in rotation such screw 231 and capable of engaging the clamping plate 33, and an end portion 233 engaged with the guiding means 240.

In this case, the slider 240 comprises a body extending along the direction X-X and having a trapezium rectangular section. In particular, the slider comprises two upper 242 and lower 243 walls parallel to each other, one inclined wall 244 connecting the two walls 242, 243 and a bottom wail 245 engaging the fixed jaw 21. The inclined wall 244 lies on a plane perpendicular to the clamping axis B-B and therefore parallel to the plane on which the surface 33*a* of the clamping plate 33 lies. On opposite side of the wall 244, the bottom wall 245 has hooking means 246 to allow the engaging of the slider 240 with the jaw 21. Namely, the hooking means 246 correspond to a flange projecting out of the planes of the two walls 242, 243 transversely of direction X-X. In order to guide the movement of the jaws 20, 21 on plane P, the two walls 242 and 243 lie on respective planes parallel to plane P and engage the respective upper walls 20*a*, 21*a* and lower walls 20*b*, 21*b* of the two jaws 20,21.

In the wall 244 a threaded hole 241 is formed for receiving the end portion 233 of the clamping screw 231.

During the tightening, the rotation of the portion 232 causes a screwing of the clamping screw 231 into the threaded hole 241 and therefore a movement of the head 232 of the screw toward the inclined wall 244 along the axis B-B. Since the head 232 is engaged with the clamping plate 33, such movement of the head 232 causes a movement of the clamping plate 33 along the clamping axis B-B and, therefore, by means of the slider 240 engaged with the jaw 21, a movement of the movable jaw 20 on plane P from the distant position (FIGS. 26-29) to the close position (FIGS. 30-33) to tighten the clamping ring 5 on a battery terminal.

According to a forth embodiment shown in FIGS. 34 to 37, showing a clamp 301, the clamping means 340 comprise a first portion 350 placed inside the housing 323 defined by the two jaws 20,21 and a second portion 351 placed outside such housing 323.

The first guiding portion 350 comprises an body extending along the direction X-X and having a trapezium rectangular section. In particular, the slider comprises two upper 342 and lower 343 walls parallel to each other, one inclined wall 344 connecting the two walls 342, 343 and a bottom wall 345 engaging the jaw 20. The inclined wall 344 lies on a plane perpendicular to the clamping axis B-B. On opposite side of the wall 344, the bottom wall 345 has hooking means 346 to allow the engaging of the first guiding portion 350 with the jaw 20. Namely, the hooking means 346 correspond to a flange projecting out of the planes of the two walls 342, 343 transversely of direction X-X. In order to guide the movement of the jaw 20 on plane P, the two walls 342 and 343 lie on respective planes parallel to plane P and engage the upper wall 20*a* and the lower wall 20*b* of the jaw 20. The movement of the jaw 21 on plane P is caused by the second portion 351 engaging the other jaw 21 outside thereof.

In the wall 344 a hole 341 is formed in which a threaded ring 334 is housed to receive the end portion 333 of the clamping screw 331. Corresponding holes 352, 353 are formed in the second portion 351 of the guiding means 340 and in the two jaws 20, 21 for the passage of clamping screw 331 which is equipped with a head 332 abutting against the clamping surface 353*a*, represented in this embodiment by a wall 353 of the second portion 351. A washer 334 is interposed between the head 332 and the clamping surface 353*a*.

During the tightening, the rotation of the clamping screw 341 causes a screwing of said screw into the threaded ring 334. Since the head 332 is engaged with the fixed jaw 21 through the second guiding portion 351, the rotation of the clamping screw 341 causes a movement of the first guiding portion 350 along the clamping direction X-X and, therefore, a movement of the movable jaw 20 on plane P from the distant position (FIG. 36) to the close position (FIG. 37) to tighten the clamping ring 5 on a battery terminal.

Figure 38:
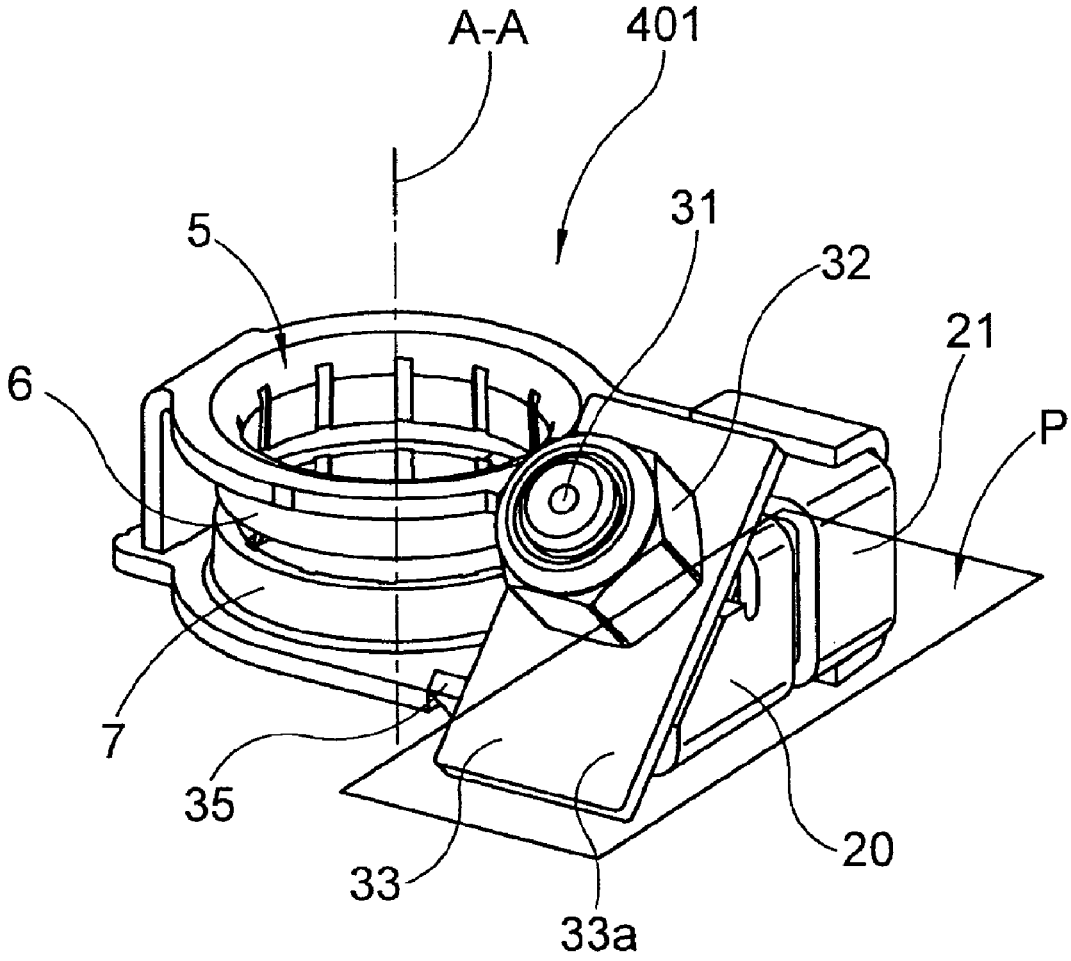
FIG. 38 shows a perspective view of a fifth embodiment of a clamp according to the present invention.
Figure 39:
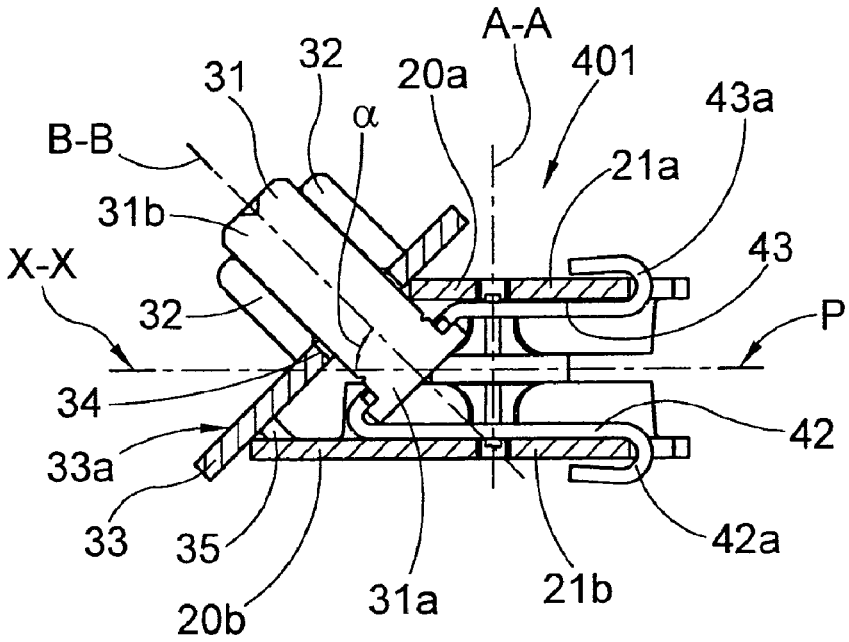
FIG. 39 shows a sectional view of the clamp of FIG. 38, with the jaws in distant position.
Figure 40:
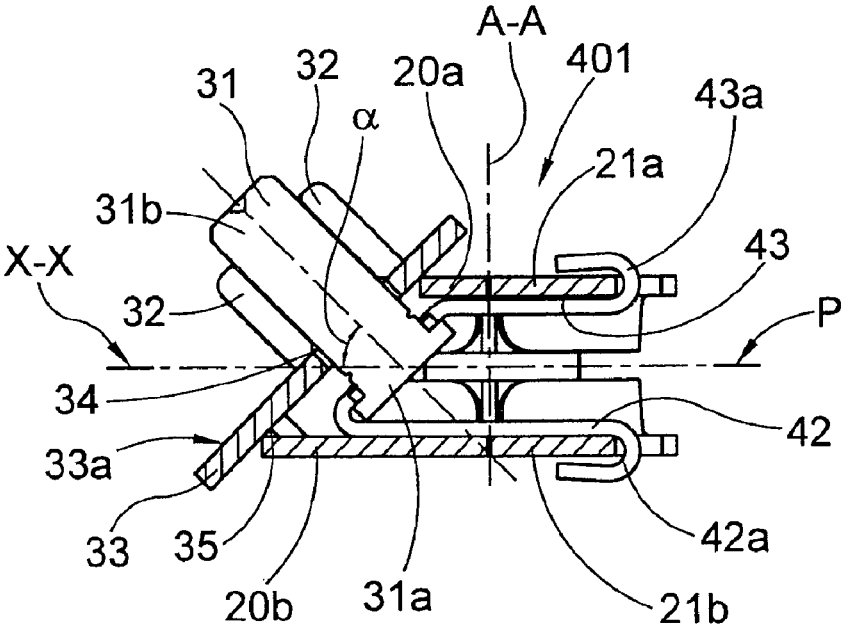
FIG. 40 shows a sectional view of the clamp of FIG. 38, with the jaws in close position.

A clamp 401 according to a fifth embodiment is shown in FIGS. 38 to 40. The clamp 401 differs from the clamp 1 of the first embodiment in that the jaw 20 is movable while the jaw 21 is fixed. In this case, the jaw 21 is movable from and towards the jaw 20.

Starting from a configuration in which the jaws 20, 21 are in distant position (FIG. 39), the tightening of the clamp 401 is carried out by rotating the clamping nut 32 on the clamping screw 34. Since the clamping nut 32 is engaged, through the clamping plate 33, with a fixed jaw 20, the rotation of the nut 32 causes a relative movement of the clamping screw 31 with respect to the nut 32 along its axis B-B and a corresponding relative movement of the plate 33 with respect to the clamping screw 31 along axis B-B. However, since the clamping screw 31 is engaged in the slider 40 which is in its turn engaged with the movable jaw 21, the clamping screw 31 moves along the direction X-X so that the slider 40, through the engaging means 42*a*, 43*a*, guides the movement of the jaw 21 along the clamping direction X-X on plane P between the distant position (FIG. 39) and the close position (FIG. 40). During the movement of the clamping screw 31 along the clamping direction X-X, the clamping plate 33 slides with respect to the jaw 20.

According to this embodiment, axis B-B of the clamping screw 31 in close position appears offset with respect to axis B-B of the clamping screw 31 in distant position. In particular, axis B-B of the clamping screw 31 in close position appears parallel to axis B-B of the clamping screw 31 in distant position. Such offset of axis B-B of the clamping screw 31 in the two positions, close and distant, allows the clamping means 30 to move with two degrees of freedom.

Figure 41:
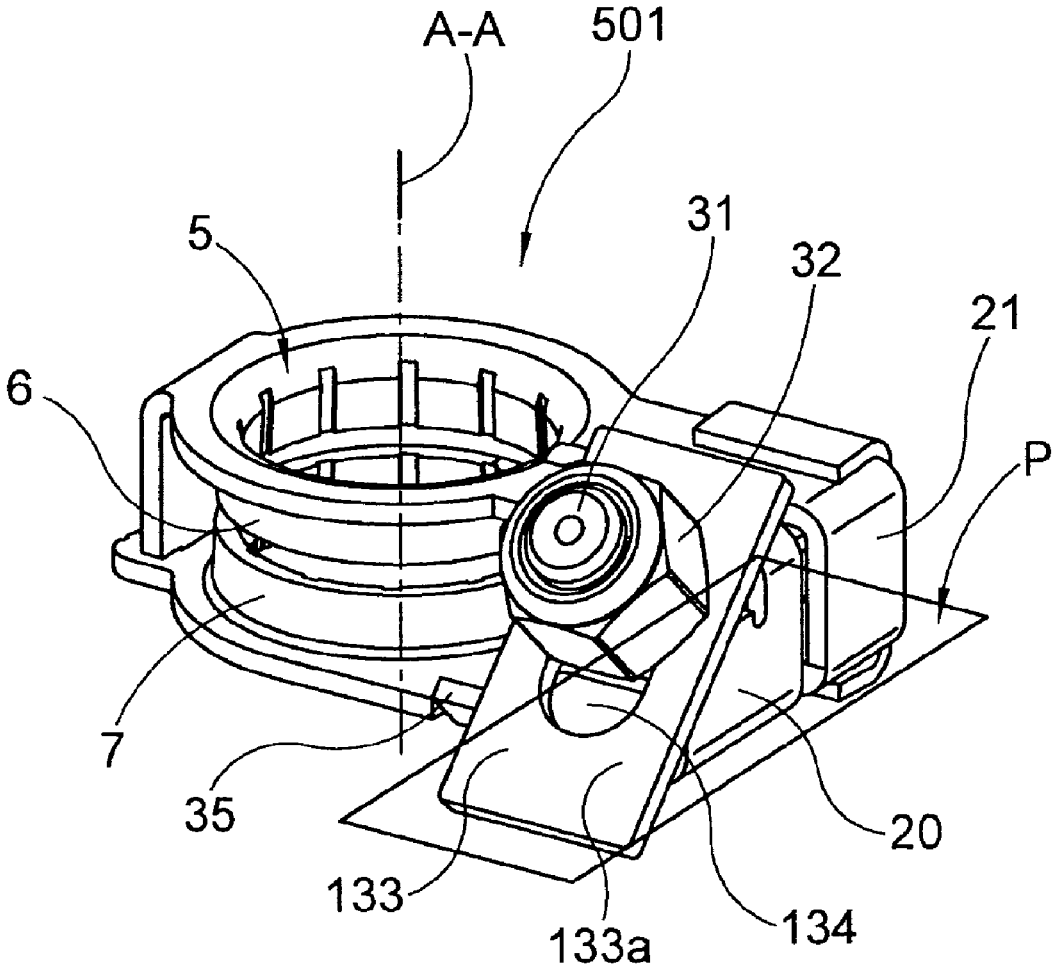
FIG. 41 shows a perspective view of a sixth embodiment of a clamp according to the present invention.
Figure 42:
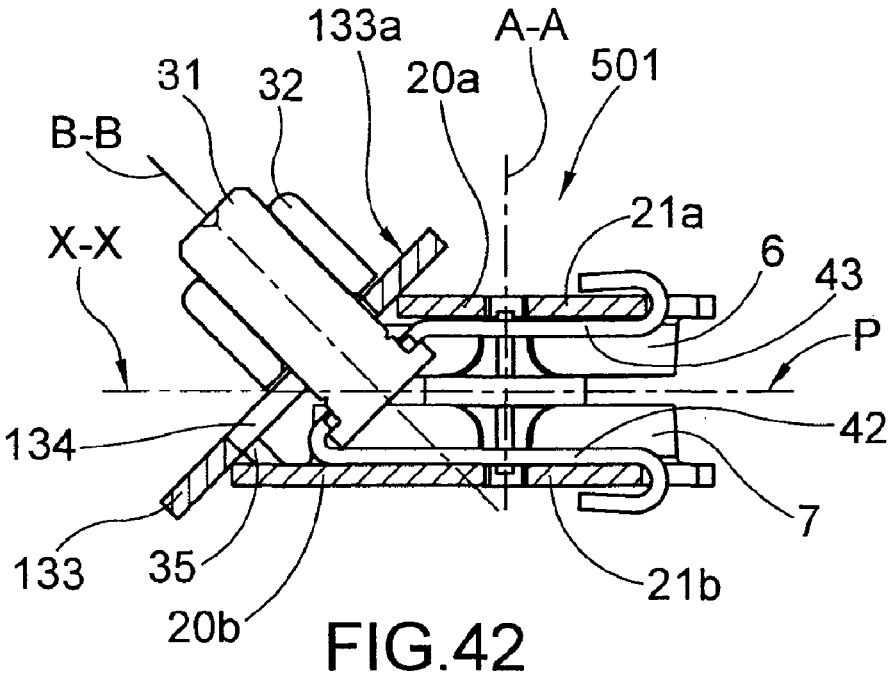
FIG. 42 shows a sectional view of the clamp of FIG. 41, with the jaws in distant position.
Figure 43:
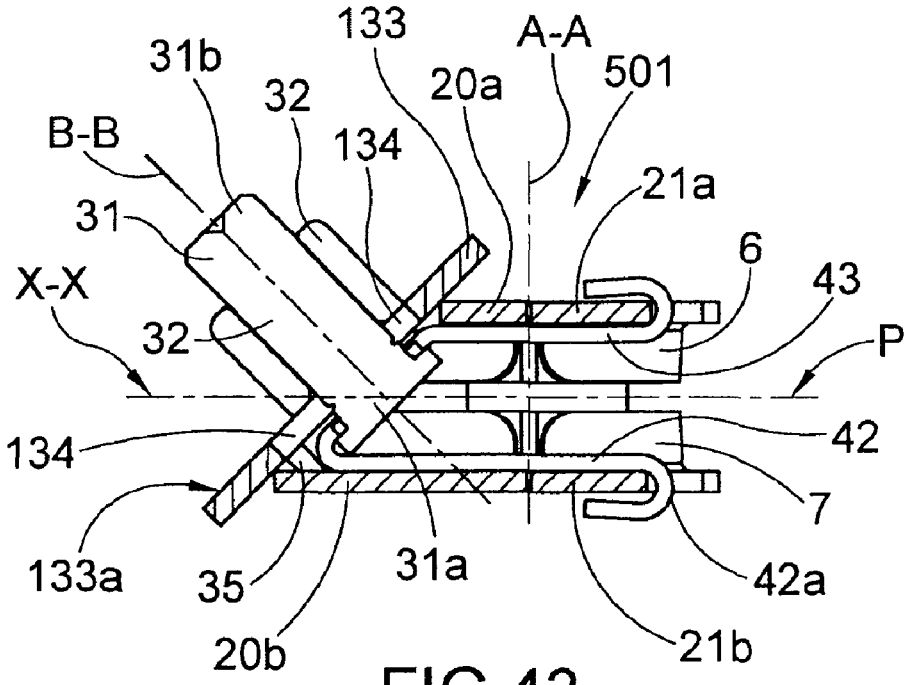
FIG. 43 shows a sectional view of the clamp of FIG. 41, with the jaws in close position.

A clamp 501 according to a sixth embodiment is shown in FIGS. 41 to 43. The clamp 501 differs from the clamp 101 of the second embodiment in that the jaw 20 is movable while the jaw 21 is fixed.

In this sixth embodiment, since the clamping screw 31 moves on plane P along the direction X-X inside the slot 134, the clamping surface 33*a* can also correspond to a connecting wall between the upper wall 20*a* and the lower wall 20*b* of the jaw 20. In this case, the slot 134 is configured so as to allow the plate 133-clamping screw 31 relative movement of the clamping means 130 not only along the clamping axis B-B but also along the clamping direction X-X.

Starting from a configuration in which the jaws 20, 21 are in distant position (FIG. 42), the tightening of the clamp 401 is carried out by rotating the clamping nut 32 on the clamping screw 31. Since the plate 133 works on the fixed jaw 20, the rotation of the nut 32 causes a relative movement of the clamping screw 31 with respect to the nut 32. Since the clamping screw 31 is engaged in the slider 40 which is in its turn engaged with the movable jaw 21, the clamping screw 31 moves along the direction X-X so that the slider 40, through the engaging means 42*a*, 43*a*, guides the movement of the jaw 21 along the clamping direction X-X on plane P between the distant position (FIG. 42) and the close position (FIG. 43). Unlike the fifth embodiment, in this case since the slot 134 is configured so as to allow the plate 133-clamping screw 31 relative movement also along the clamping direction X-X, the plate 133 remains in its position and the clamping screw 31 slides into the slot 134 along the clamping direction X-X on plane P until it reaches the position shown in FIG. 43. Also in this embodiment, axis B-B of the clamping screw 31 in close position appears offset with respect to axis B-B of the clamping screw 31 in distant position. In particular, axis B-B of the clamping screw 31 in close position appears parallel to axis B-B of the clamping screw 31 in distant position.

As it can be understood from FIGS. 39, 40 and 42, 43, the clamping screw 31 moves, between the distant position and the close position, with a movement comprising a component perpendicular to the clamping axis B-B. In particular, the clamping screw 31, as it is secured to the guiding means 40, moves along the clamping direction X-X.

As it can be appreciated from the above, the clamp according to the present invention allows to overcome the above-mentioned drawbacks with reference to the known art. Namely, the tightening of the clamp is carried out without torsions of the two clamping jaws which move on a plane perpendicular to the clamping ring axis.

Obviously, those skilled in the art, in order to meet contingent and specific needs, will be able to make many changes and alterations to the clamp according to the invention described hereinbefore, all however falling within the protection scope of the invention as defined by the following claims.

The invention claimed is:

1. A clamp for a male terminal comprising:

a clamping ring having an axis, said clamping ring being able to insert on a male terminal according to an insertion direction extended along said axis;

two jaws connected to said clamping ring and mutually approaching to tighten the clamping ring on the male terminal, at least one of said jaws being movable;

clamping means acting on said jaws to move said jaws between a distant position and a close position along a clamping direction;

wherein said clamping means comprise a clamping member rotatable around a clamping axis to move the jaws between said distant position and said close position, said clamping axis being inclined with respect to a plane perpendicular to the axis of the clamping ring so as to form with said plane an angle different from the right angle;

wherein said clamp comprises guiding means cooperating with said at least one movable jaw to guide the movement of said at least one movable jaw along said clamping direction on said plane, between said distant position and said close position.

2. The clamp according to claim 1, wherein said guiding means comprise a slider connected to said clamping member and equipped with engaging means to engage one of said two jaws.

3. The clamp according to claims 1, wherein said guiding means cooperate with said clamping means to guide the movement of the at least one movable jaw along said clamping direction on said plane, between said distant position and said close position.

4. The clamp according to claims 1, wherein said clamping ring is represented by at least one open ring having two opposed arms with two opposed end portions mutually approachable to tighten the clamping ring around the male terminal when the clamp is mounted on the male terminal, said two jaws being connected to a respective end portion of said at least one open ring.

5. The clamp according to claim 1, wherein each jaw comprises an upper wall and a lower wall parallel to each other, said guiding means comprise a guiding element having an upper wall and a lower wall lying on respective planes parallel to said plane and engaged with respective upper and lower walls of the two jaws to guide said two jaws.

6. The clamp according to claim 1, wherein said guiding means cooperate with said two jaws to guide the movement of said jaws on said plane, between said distant position and said close position.

7. The clamp according to claim 6, wherein said guiding means comprise a slider connected to said clamping member and equipped with engaging means to engage one of said two jaws.

8. The clamp according to claim 1, wherein said clamping means comprise a clamping surface lying on a plane perpendicular to said clamping axis and represented by a clamping element cooperating with one of said two jaws, said rotatable clamping member acting on said clamping surface to move said two jaws between the distant position and the close position.

9. The clamp according to claim 8, wherein said two jaws comprise a fixed jaw and a movable jaw, said clamping element cooperating with said fixed jaw, the clamping axis in the close position being offset with respect to the clamping axis in the distant position.

10. The clamp according to claim 9, wherein said rotatable clamping member moves, between said distant position and said close position, with a movement comprising a component perpendicular to the clamping axis.

11. The clamp according to claim 8, wherein said clamping element is a clamping plate interposed between said rotatable clamping member and the jaw with which said clamping element cooperates.

12. The clamp according to claim 11, wherein said rotatable clamping member comprises a screw having a portion operable in rotation and capable of engaging said clamping plate and an end portion engaged with said guiding means, the rotation of the portion operable in rotation of the clamping screw causing the movement of said at least one movable jaw on said plane, between said distant position and said close position.

13. The clamp according to claim 11, wherein said clamping means comprise a screw secured at one end to said guiding means and having a free end, said rotatable clamping member comprising a clamping nut mounted on said screw on the side of the free end and capable of engaging said clamping plate, the rotation of said clamping nut causing the movement of said at least one movable jaw on said plane, between said distant position and said close position.

* * * * *